US010821748B2

(12) United States Patent
Mori

(10) Patent No.: US 10,821,748 B2
(45) Date of Patent: Nov. 3, 2020

(54) RECORDING APPARATUS

(71) Applicant: SEIKO EPSON CORPORATION, Tokyo (JP)

(72) Inventor: Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/045,449

(22) Filed: Jul. 25, 2018

(65) Prior Publication Data

US 2019/0030920 A1 Jan. 31, 2019

(30) Foreign Application Priority Data

Jul. 28, 2017 (JP) ..... 2017-147020
Feb. 28, 2018 (JP) ..... 2018-035272

(51) Int. Cl.

| | |
|---|---|
| ***B65H 3/44*** | (2006.01) |
| ***B65H 1/04*** | (2006.01) |
| ***B65H 1/26*** | (2006.01) |
| ***B41J 11/00*** | (2006.01) |
| ***G03G 15/00*** | (2006.01) |

(Continued)

(52) U.S. Cl.

CPC ..... *B41J 11/0045* (2013.01); *B41J 13/103* (2013.01); *B41J 13/106* (2013.01); *B41J 29/023* (2013.01); *B65H 1/04* (2013.01); *B65H 1/12* (2013.01); *B65H 1/266* (2013.01); *B65H 3/06* (2013.01); *B65H 3/0607* (2013.01); *B65H 3/0669* (2013.01); *B65H 3/0684* (2013.01); *B65H 3/44* (2013.01); *B65H 29/58* (2013.01); *B65H 31/02* (2013.01); *G03G 15/6529* (2013.01); *G03G 15/6552* (2013.01); *G03G 21/1604* (2013.01); *G03G 21/1609* (2013.01); *B65H 2301/33312* (2013.01); *B65H 2301/4212* (2013.01); *B65H 2403/513* (2013.01); *B65H 2405/115* (2013.01); *B65H 2405/11151* (2013.01); *B65H 2405/121* (2013.01); *B65H 2405/332* (2013.01); *B65H 2405/3321* (2013.01); *B65H 2405/3322* (2013.01); *B65H 2407/21* (2013.01); *B65H 2511/12* (2013.01); *B65H 2511/22* (2013.01);

(Continued)

(58) Field of Classification Search

CPC ..... G03G 21/1609; G03G 2215/00392; B65H 2601/523; B65H 2407/21; B65H 2405/3322; B65H 2405/332; B65H 2511/12; B65H 3/44; B65H 1/04; B65H 1/266; B41J 13/103

See application file for complete search history.

(56) References Cited

U.S. PATENT DOCUMENTS 5,411,248 A * 5/1995 Yamaguchi ..... B65H 1/04 271/145
6,105,953 A * 8/2000 Komuro ..... B41J 13/00 271/186

(Continued)

FOREIGN PATENT DOCUMENTS

JP 61188348 A * 8/1986
JP 63277146 A * 11/1988

(Continued)

*Primary Examiner* — Luis A Gonzalez
(74) *Attorney, Agent, or Firm* — Workman Nydegger

(57) ABSTRACT

There is provided a recording apparatus with which it is possible to reduce an occupied space to a small size in a configuration of including a mounting unit and a receiving unit.

10 Claims, 14 Drawing Sheets

(51) Int. Cl.

| | |
|---|---|
| ***B65H 3/06*** | (2006.01) |
| ***B65H 29/58*** | (2006.01) |
| ***B41J 29/02*** | (2006.01) |
| ***B65H 31/02*** | (2006.01) |
| ***B65H 1/12*** | (2006.01) |
| ***G03G 21/16*** | (2006.01) |
| ***B41J 13/10*** | (2006.01) |

(52) U.S. Cl.
CPC .. *B65H 2601/325* (2013.01); *B65H 2601/523* (2013.01); *B65H 2801/06* (2013.01)

(56) References Cited

U.S. PATENT DOCUMENTS 6,308,027 B1 * 10/2001 Obu ..... G03G 15/00 399/110
6,665,047 B1 * 12/2003 Kimura ..... G03G 21/1609 355/40
6,709,177 B1 * 3/2004 Sugimura ..... B41J 13/103 271/9.11
6,985,687 B2 * 1/2006 Mochimaru ..... G03G 15/238 399/101
2010/0060956 A1 * 3/2010 Harada ..... G03G 15/6555 358/498
2012/0070185 A1 * 3/2012 Yokota ..... G03G 21/1832 399/110
2017/0090382 A1 * 3/2017 Tatematsu ..... B65H 1/04
2017/0283194 A1 * 10/2017 Nakagawa ..... B65H 3/0684

FOREIGN PATENT DOCUMENTS

JP 2001122478 A * 5/2001
JP 2003312870 A * 11/2003
JP 2004-025588 A 1/2004

* cited by examiner

RECORDING APPARATUS

BACKGROUND

1. Technical Field

The present disclosure relates to a recording apparatus including a mounting unit on which a medium such as a sheet of paper is mounted, a recording unit that performs recording (printing) on the medium supplied from the mounting unit, and a receiving unit such as a stacker that receives the medium discharged after the recording.

2. Related Art

JP-A-2004-25588 discloses a recording apparatus (image forming apparatus) including a cassette that accommodates a medium such as a sheet of paper and a manual feed unit (an example of a mounting unit) on which the medium is mountable (settable). The cassette is attached below an apparatus main body (housing) in a detachable manner from a front surface of the recording apparatus. In addition, the manual feed unit is provided on an under surface of a recessed portion provided to be recessed between the cassette and an image reading unit in the apparatus main body. The medium is horizontally fed from the cassette and the manual feed unit, and the medium after the recording performed by the recording unit is discharged to the stacker (an example of a receiving unit) extending outside from one side surface of the apparatus main body. Therefore, the medium that has been horizontally supplied from the cassette and the manual feed unit toward the recording unit can be horizontally discharged to the cassette while a state of the medium is maintained after the recording performed by the recording unit. In addition, the manual feed unit is provided with a paper end regulating surface (edge guide) that positions the medium in a width direction.

However, in the recording apparatus disclosed in JP-A-2004-25588, the stacker extends outside the apparatus main body, and thus a problem arises in that it is necessary to secure a space for the stacker extending outside when the recording apparatus is installed, and an occupied space including a space, which is required when the recording apparatus is installed, becomes relatively broad by an equivalent amount of the space of the extending stacker.

SUMMARY

An advantage of some aspects of the disclosure is to provide a recording apparatus with which it is possible to reduce an occupied space to a small size in a configuration of including a mounting unit and a receiving unit.

Hereinafter, means of the disclosure and operation effects thereof will be described.

According to an aspect of the disclosure, there is provided a recording apparatus including: a mounting unit that is provided with a mounting surface, on which a medium is mountable, and that is open on at least one side of one side in a direction intersecting with a supply direction of the medium on the mounting surface and an upstream side in the supply direction of the medium; a medium accommodating unit that accommodates a medium; a first supply unit that supplies the medium mounted on the mounting unit in the supply direction; a second supply unit that supplies the medium accommodated in the medium accommodating unit; a recording unit that performs recording on the supplied medium; and a receiving unit that receives the medium after the recording. The medium accommodating unit, the mounting unit, and the receiving unit are disposed to overlap each other in a vertical direction.

In this configuration, the mounting unit on which the medium is mountable, the medium accommodating unit that accommodates the medium, and the receiving unit that receives the medium discharged from the discharge port are disposed to overlap each other in the vertical direction. Therefore, a size of the recording apparatus is reduced to be relatively small in a direction intersecting with the vertical direction. Accordingly, it is possible to reduce an occupied space of the recording apparatus to a small size in a configuration of including the mounting unit and the receiving unit.

It is preferable that the recording apparatus further include: a reverse transport route through which a medium, on which recording has performed, is transported along with reversing of the medium; and a discharge unit that discharges the reversed medium from a discharge port to the receiving unit.

In this configuration, the medium supplied from the mounting unit or the medium accommodating unit, on which the recording has been performed by the recording unit, is reversed through the reverse transport route and is discharged from the discharge port to the receiving unit. Therefore, the mounting unit and the receiving unit can be disposed on the same side as the recording unit, and thus it is easy to secure a relatively large amount of overlap between the mounting unit and the receiving unit which overlap each other in the vertical direction. As a result, the recording apparatus can have a small size in the direction intersecting with the vertical direction, and thereby it is possible to reduce an occupied space of the recording apparatus to a small size.

In the recording apparatus, it is preferable that, when viewed horizontally from front, the mounting unit and the receiving unit be disposed in a positional relationship in which the mounting unit includes a projection region of the receiving unit, which is obtained in a case where the receiving unit is projected on the mounting unit in the vertical direction.

In this configuration, when the recording apparatus is viewed horizontally from front, the mounting unit and the receiving unit overlap each other in the vertical direction in a state in which the mounting unit includes the projection region of the receiving unit. Since it is possible to secure a large amount of overlap of the mounting unit and the receiving unit, it is possible to reduce the recording apparatus to a small size in a lateral direction when viewed horizontally from front, thereby making it possible to reduce the occupied space of the recording apparatus to a small size.

In the recording apparatus, it is preferable that the receiving unit cover an upper side of the mounting unit.

In this configuration, since the upper side of the mounting unit is covered with the receiving unit, dust is unlikely to be accumulated on the medium even when the medium remains as is mounted on the mounting unit.

It is preferable that the recording apparatus further include: a scanner and, when viewed horizontally from front, the mounting unit and the scanner be disposed in a positional relationship in which the scanner includes a projection region of the mounting unit, which is obtained in a case where the mounting unit is projected on the scanner in the vertical direction.

In this configuration, when the recording apparatus is viewed horizontally from front, the scanner and the mounting unit overlap each other in the vertical direction in a state in which the scanner includes the projection region of the mounting unit. Since it is possible to secure a large amount of overlap of the scanner and the mounting unit, the size of the recording apparatus in a lateral direction is reduced to be small when viewed horizontally from front, thereby making it possible to reduce the occupied space of the recording apparatus to a small size.

In the recording apparatus, it is preferable that the mounting unit tilt in a posture in which a downstream end of the mounted medium in the supply direction is positioned on a lower side than an upstream end thereof in the vertical direction.

In this configuration, since the mounting unit tilts in an orientation in which the side of the downstream end of the mounted medium in the supply direction (feed direction) is lower, it is easy to mount the media in a state in which leading ends (downstream ends) of the media are neatly arranged on the mounting unit, and thus there is no need to provide a tail end edge guide for guiding tail ends (upstream ends) of the media. The tilt of the posture of the mounting unit enables the mounting unit to have a relatively short length in the supply direction in proportion to a length of a medium to be mounted, compared to a case where the mounting unit does not tilt (for example, a case of a horizontal posture). Therefore, the size of the recording apparatus in the supply direction is reduced to be small, and thereby the occupied space of the recording apparatus is reduced to the small size.

In the recording apparatus, when viewed from the vertical direction, it is preferable that a downstream end of the medium accommodated in the medium accommodating unit in the supply direction be positioned to be closer to the recording unit in the supply direction than the downstream end of the medium mounted on the mounting unit in the supply direction, and the first supply unit and the second supply unit be disposed in a state in which at least a part of each of the first supply unit and the second supply unit is positioned at the same height in the vertical direction.

In this configuration, since the first supply unit and the second supply unit are disposed in the state in which at least a part of each of the first supply unit and the second supply unit is positioned at the same height in the vertical direction, the size (height size) of the recording apparatus in the vertical direction can be reduced to be smaller, compared to a configuration in which there is no portion that is disposed at the same height in the vertical direction. Accordingly, an occupied space of the recording apparatus in a height direction is reduced to be small.

In the recording apparatus, it is preferable that the mounting unit have an edge guide that is able to guide the medium in a width direction intersecting with the supply direction, and the edge guide be configured to be movable between a guide position at which the edge guide is disposed when guiding the medium in the width direction and a retraction position at which the edge guide is retracted by rotating or being displaced downward from the guide position.

In this configuration, the edge guide is caused to move from the guide position to the retraction position, and thereby it is easy to mount the medium on the mounting unit. After the medium is mounted, the edge guide is caused to move to the guide position, and thereby it is possible to position the medium mounted on the mounting unit at an appropriate supply position in the width direction. Therefore, it is easy to set the medium on the mounting unit without interference of the edge guide even from a front side (a side of a direction intersecting with the supply direction) of the recording apparatus. Accordingly, a user does not need to set the medium by avoiding the edge guide and turning from a side (the side of the tail in the supply direction) of a housing, and there is no need to secure a work space for setting the medium on the side of the housing. This contributes to a reduction in the occupied space of the recording apparatus.

It is preferable that the recording apparatus further include: a holding mechanism that holds the edge guide at the retraction position.

In this configuration, since the holding mechanism enables the edge guide to be held at the retraction position, the edge guide does not interfere with the mounting of the medium on the mounting unit. When the medium is mounted on the mounting unit, then, the holding by the holding mechanism is canceled, and the edge guide is returned from the retraction position to the guide position, it is possible to position the medium on the mounting unit in the width direction by the edge guide.

In the recording apparatus, it is preferable that the edge guide be rotatable to the guide position and the retraction position around a side of a lower end portion or a side of one end portion of the edge guide in the supply direction as a rotation axis, and the recording apparatus further include a holding mechanism that holds the edge guide at the guide position.

In this configuration, since it is possible to hold the edge guide at the guide position, the edge guide at the guide position is capable of avoiding rotation due to its own weight or reception of an external force. Accordingly, the edge guide is capable of more reliably guiding the medium in the width direction.

In the recording apparatus, it is preferable that the edge guide be rotatable to the guide position and the retraction position around a side of a lower end portion or a side of one end portion of the edge guide in the supply direction as a rotation axis, and an upper surface portion of the mounting unit and an under surface portion of the edge guide be uneven to mesh with each other in a state in which the edge guide is disposed at the guide position.

In this configuration, when the medium is mounted on the mounting unit, and then the edge guide is rotated from the retraction position to the guide position, a gap between the under surface portion of the edge guide and the upper surface portion of the mounting unit has an uneven shape by meshing between the uneven portions, and thus it is possible to prevent the medium from entering the gap.

In the recording apparatus, it is preferable that the mounting unit have a hopper that is movable between a feed position at which the medium mounted on the mounting unit comes into contact with a roller constituting the first supply unit and a standby position at which the medium is separated from the roller. It is preferable that, when the edge guide moves from the guide position to the retraction position in a state in which the hopper is disposed at the feed position, the hopper be caused to move from the feed position to the standby position.

In this configuration, when the edge guide is moved from the guide position to the retraction position, and the hopper is disposed at the feed position at that time, the hopper moves from the feed position to the standby position and is separated from the roller, and thus it is easy to mount (set) the medium on the mounting unit, compared to a case where the hopper is disposed at the feed position.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Figure 1:
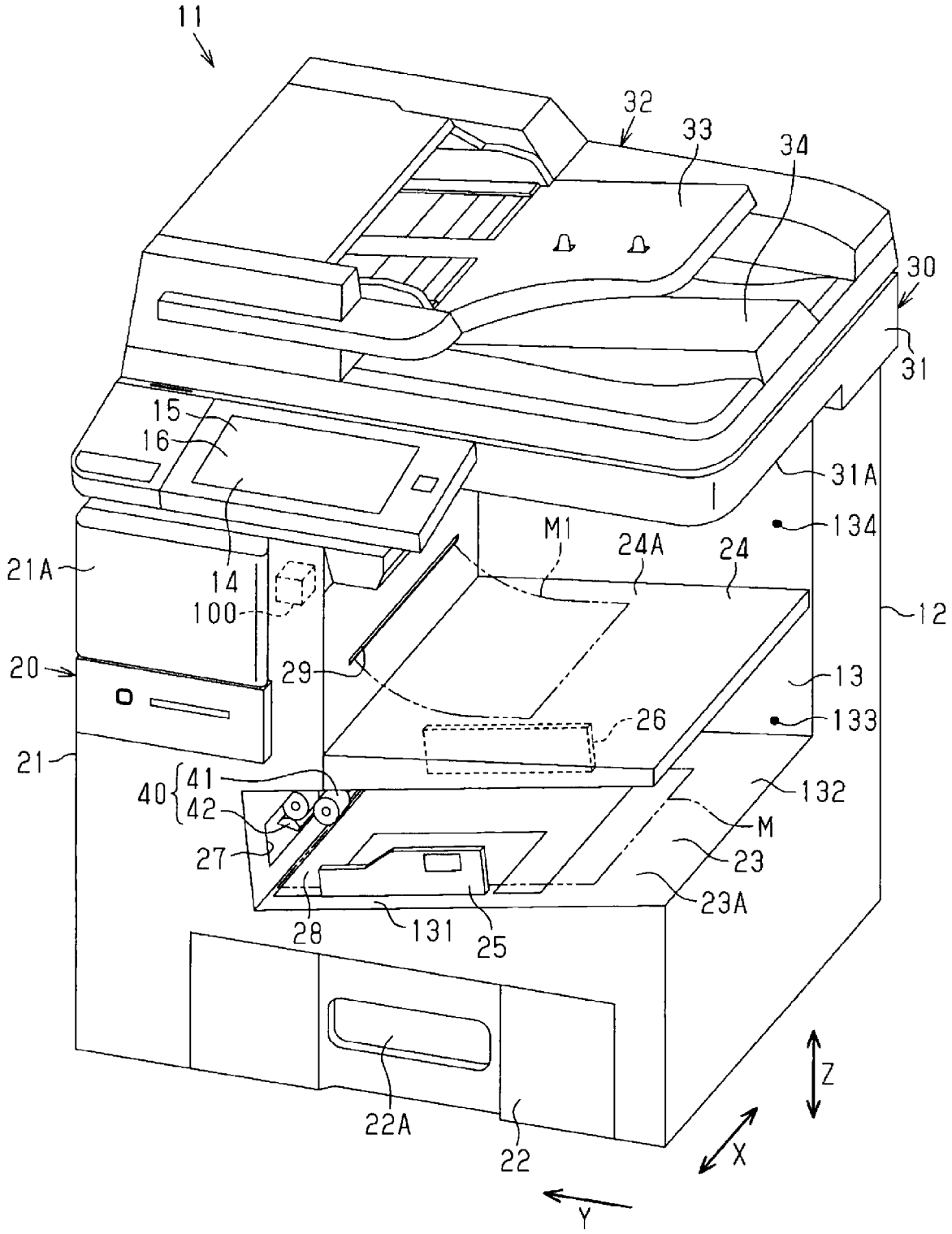
FIG. 1 is a perspective view schematically illustrating a recording apparatus configuring a multifunction printer in a first embodiment.

Hereinafter, the first embodiment of a recording apparatus will be described with reference to the drawings. A recording apparatus 11 of the embodiment illustrated in FIG. 1 is a multifunction printer having a scanner function, a copy function, and the like, in addition to a printing function. As illustrated in FIG. 1, the recording apparatus 11 includes a printing device 20 that performs recording (printing) on a medium M and an image reading device 30 as an example of a scanner that reads (scans) an original document or the like. The recording apparatus 11 has a configuration in which the printing device 20 and the image reading device 30 are stacked to overlap each other in a vertical direction Z. In other words, the image reading device 30 is disposed above the printing device 20.

The recording apparatus 11 includes a housing 12 having an upper portion provided with a main body 31 of the image reading device 30 is provided. The housing 12 is provided with a recessed portion 13 that is opened in two surfaces of a front surface on a forward side and a side surface on the right side. The recessed portion 13 is provided with a first opening 131 that is opened in the front surface of the housing 12 and a second opening 132 that is opened in the side surface on one side (right side in an example of FIG. 1) of the housing 12. In the example, the first opening 131 and the second opening 132 are continuous to each other and are open.

The recessed portion 13 is provided with a blocked portion on a rear side which is opposite to the first opening 131 in the front surface and a portion opposite to the second opening 132 in the right side surface, which is blocked by a wall surface (right wall surface) of a quadrangular column-shaped printing function unit 21 constituting the printing device 20. In addition, an upper inner wall surface of the recessed portion 13 is formed by an under surface of the main body 31 having a substantially quadrangular plate shape, which constitutes the image reading device 30. In other words, an upper side of the recessed portion 13 is covered with a part of the main body 31. Hereinafter, the main body 31 is also referred to as a "scanner main body 31".

The printing device 20 includes the quadrangular column-shaped printing function unit 21 described above in a portion next to (on the left of) the recessed portion 13 in the housing 12. A cassette 22 as an example of a medium accommodating unit that is capable of accommodating a plurality of media M (for example, sheets of paper) in a stacked state, is detachably inserted below the housing 12. The recessed portion 13 is positioned above the cassette 22 in the vertical direction Z. The cassette 22 is disposed at a position below the printing function unit 21 and the recessed portion 13 in the housing 12. The cassette 22 is provided with a grip portion 22A on a front surface thereof. A user can perform an operation of attaching and detaching the cassette 22 to and from the housing 12 by using the grip portion 22A and draws the cassette 22 out forward, thereby, performing refilling or the like the cassette 22 with the medium M. In addition, the recording apparatus 11 includes an operation panel 14 as an example of an operation unit is disposed at an upper forward position of the printing function unit 21. The printing function unit 21 includes a cover 21A, which is opened and closed when an ink containing portion 59 (refer to FIG. 3) to be described below is attached and detached, is provided in a portion below the operation panel 14. The recording apparatus 11 is capable of including one or a plurality of cassettes 22 more below the cassette 22.

As illustrated in FIG. 1, a supply tray 23 as an example of the mounting unit, on which the medium M is mounted, is disposed in a portion corresponding to the under surface of the recessed portion 13 in the housing 12. The supply tray 23 is provided with a mounting surface 23A, on which a plurality of media M to be supplied are mountable in a stacked state, and has one side (forward side) of the supply tray in a direction (depth direction) intersecting with (for example, orthogonal to) a supply direction of the medium M on the mounting surface 23A, which is open by the first opening 131, and an upstream side of the supply tray in the supply direction of the medium M on the mounting surface 23A, which is open by the second opening 132. Therefore, the user can mount, via the openings 131 and 132, the medium M on the mounting surface 23A of the supply tray 23 that is positioned on the under surface of the recessed portion 13. In addition, a stacker 24 (discharge stacker) is provided at a height position above the supply tray 23 in the recessed portion 13, the stacker as an example of a receiving unit that receives a medium (hereinafter, referred to as a "recorded medium M1") discharged from a discharge port 29 after the printing (recording) is performed in the printing function unit 21. In this specification, the supply direction, in which the medium M on the mounting surface 23A is supplied, is referred to as a feed direction Y (left direction in FIGS. 1 and 2), and a direction intersecting with (orthogonal to) the feed direction Y is referred to as a width direction X. As described above, the housing 12 has a front forward side of both sides in the width direction X which is open by the first opening 131 and an upstream side in the feed direction Y which is open by the second opening 132 of the recessed portion 13. The supply tray 23 has one side (front forward side) in the width direction X which is open by the first opening 131 with respect to a space in which the media M are mountable on the mounting surface 23A in the stacked state, that is, a space between the mounting surface 23A and the under surface of the stacker 24, and an upstream side in the feed direction Y which is open by the second opening 132.

As illustrated in FIG. 1, the supply tray 23 includes a pair of edge guides 25 and 26 that guides the medium M on the mounting surface 23A in the width direction X (depth direction) intersecting with (for example, orthogonal to) the feed direction Y in which the medium is supplied. The pair of edge guides 25 and 26 is operated by the user when the medium M mounted on the mounting surface 23A is positioned in the width direction X.

The pair of edge guides 25 and 26 is configured to project upward from the mounting surface 23A and to be movable in the width direction X of the medium M in a link with each other. The pair of edge guides 25 and 26 has a function of positioning the medium M on the mounting surface 23A in the width direction X. The pair of edge guides 25 and 26 in the embodiment moves in a link with symmetrical positions in the width direction X with respect to a width center line of the medium M on the supply tray 23 and employs a center feed method in which it is possible to position the medium M at a position at which the width center of the medium is coincident with the width center of a feed port 27. Instead of the configuration of the center feed method, the pair of edge guides 25 and 26 may have a configuration in which one edge guide is fixed and the other edge guide is movable, the other edge guide is moved with the edge guide on the fixed side as a reference, and thereby the medium M is positioned to be closer to one end in the width direction X.

In the example of the recording apparatus 11 illustrated in FIG. 1, in the printing function unit 21, the printing is performed on the medium M fed into the printing function unit 21 via the feed port 27 in a state in which the medium is positioned in the width direction X from the supply tray 23 by the pair of edge guides 25 and 26, and then the medium is discharged to the stacker 24 via the discharge port 29 and is stacked on the receiving surface 24A.

In the recording apparatus 11 illustrated in FIG. 1, the first opening 131 that is open in a forward front surface of a space above the supply tray 23, in which the medium M is mounted, and a space above the stacker 24, in which the recorded medium M1 is mounted, and the second opening 132 that is open in the side surface on the upstream side in the feed direction Y are continuous to each other and are open. Therefore, even when the supply tray 23 and the stacker 24 are configured to be disposed in the recessed portion 13 of the housing 12, the user easily sets the medium M to the supply tray 23 via the openings 131 and 132 and easily takes out the recorded medium M1 from the stacker 24. In other words, since the front surface and the right-side surface of the recessed portion 13 are continuous to each other and are open by the two openings 131 and 132, the user can easily access the supply tray 23 and the stacker 24 from the front surface of the recording apparatus 11.

As illustrated in FIG. 1, the image reading device 30 includes an automatic feed device 32, which feeds an original document automatically, above the scanner main body 31. In addition, the image reading device 30 includes a reading unit (not illustrated) that reads a character, a picture, or the like which is recorded on the original document fed by the automatic feed device 32. The automatic feed device 32 includes a tray 33 on which original documents are mountable in a stacked state and feeds the original documents stacked on the tray 33 one by one. The image reading device 30 causes the reading unit to read the original document fed from the tray 33, and the original document after the reading is discharged to a discharge target portion 34 provided below the tray 33. The automatic feed device 32 is rotatable with respect to the scanner main body 31, and a lower portion of the automatic feed device serves as a platen cover of the image reading device 30. The user rotates the automatic feed device 32 from a closed state to an opened state illustrated in FIG. 1, and thereby a platen (glass surface) (not illustrated) which is disposed on an upper surface portion of the scanner main body 31, is exposed. The scanner main body 31 is configured to include constituent components including the reading unit that read the original document and a moving mechanism that moves the reading unit in a scanning direction, for example, and a housing unit that accommodates the constituent components and has an upper surface portion that forms the platen with a glass plate, on which the original document is mounted, being assembled in an upper portion thereof.

The operation panel 14, which is used to perform various types of operations for giving instructions to the recording apparatus 11, is disposed on the front side of the image reading device 30. The operation panel 14 includes an operation unit 15 and a display unit 16. For example, the display unit 16 is configured of a touch panel, and the operation unit 15 is configured to have a touch operation inputting function of the touch panel. In addition, the recording apparatus 11 includes a control unit 100 that collectively controls the recording apparatus 11. The operation unit 15 may be configured of an operation switch or the like.

In addition, in the recording apparatus 11, one side surface on a side, on which the operation panel 14 is disposed, of four side surfaces is the front surface. In addition, in the recording apparatus 11, one side surface on a side, on which a portion including a grip portion 22A of the cassette 22 accommodated in the housing 12, of the four sides is the front surface. In FIG. 1, a surface on the forward side of the recording apparatus 11 is the front surface.

Figure 2:
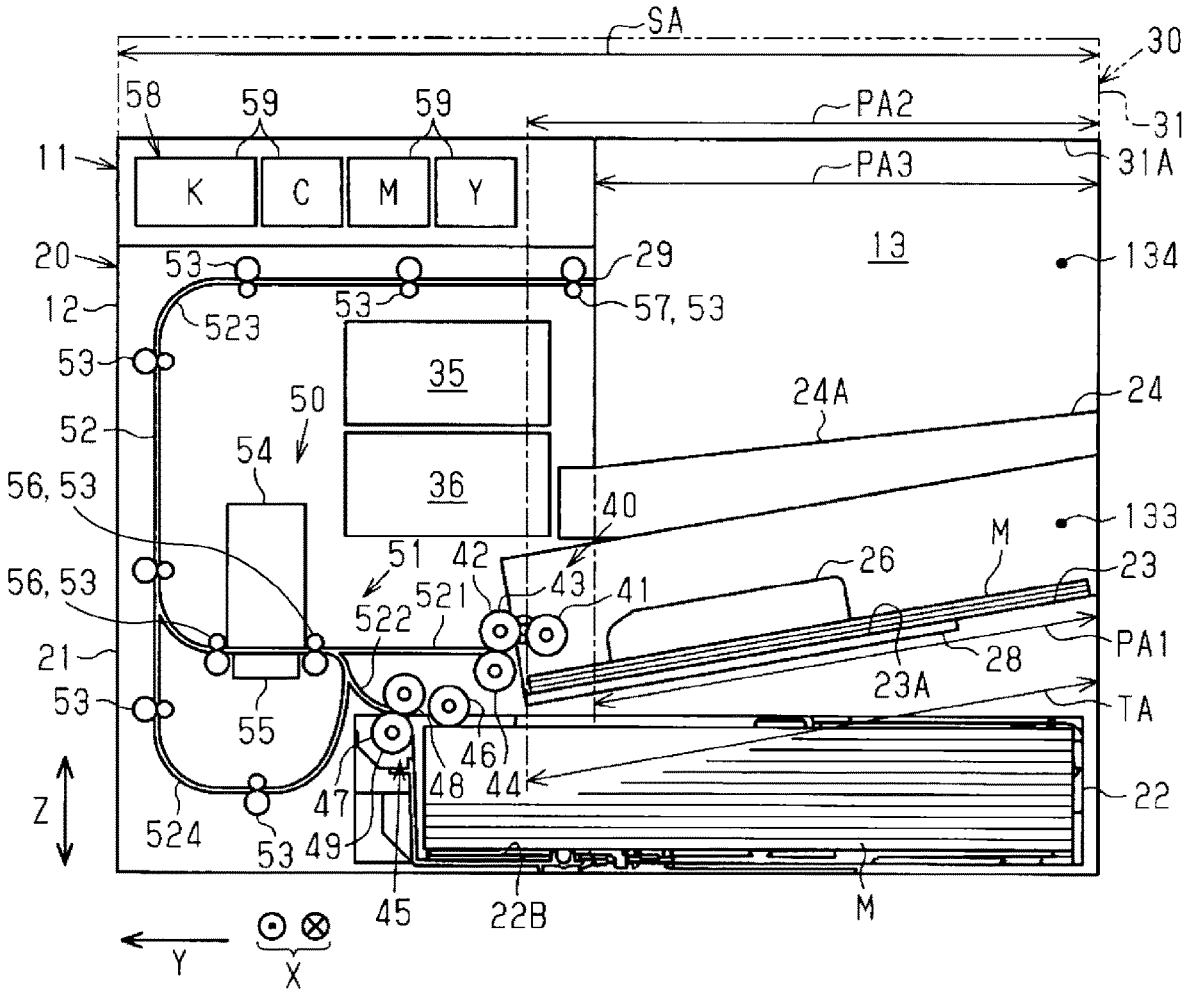
FIG. 2 is a sectional side view schematically illustrating the recording apparatus.

As illustrated in FIGS. 1 and 2, the supply tray 23 has an upper surface which is the mounting surface 23A on which the medium M before recording is mountable and is disposed in an obliquely tilting posture in which a downstream end side of the medium M on the mounting surface 23A in the feed direction Y is below an upstream end side in the direction of gravitational force (vertical direction Z). Accordingly, when the media M are mounted on the supply tray 23, the media move due to their own weight in the feed direction Y, and front ends of the media M hit a wall surface of the printing function unit 21, and thereby the front ends are arranged in an aligned state. Therefore, there is no need to provide a tail end edge guide for guiding tail ends of the media M in the feed direction Y. In addition, the supply tray 23 has the tilting posture, and thereby it is possible to relatively shorten the supply tray 23 in length in the feed direction Y, which is required for mounting the medium M having a predetermined length on the mounting surface 23A, compared to a case of a non-tilting posture (for example, a horizontal posture). In other words, it is possible to shorten the supply tray 23 in length in the feed direction Y in proportion to a length of the medium M to be mounted. In addition, the posture of the supply tray 23 tilts, and thereby the tail end portion of the medium M does not extend outside from the recessed portion 13 or it is possible to reduce an amount of extension in a case where a relatively long medium M is mounted on the supply tray 23.

As illustrated in FIGS. 1 and 2, the stacker 24 has an upper surface which is the receiving surface 24A which receives the recorded medium M1 and is disposed in an obliquely tilting posture in which an upstream end side of the medium M1 on the receiving surface 24A in a discharge direction −Y is below a downstream end side in the direction of gravitational force (vertical direction Z). In other words, the supply tray 23 and the stacker 24 tilt in the same orientation. When the media M1 are discharged on the stacker 24, the media M1 move due to their own weight to a side opposite to the discharge direction −Y, tail ends of media M1 hit a wall surface of the printing function unit 21, and thereby the tail ends are arranged on the receiving surface 24A in an aligned state. Therefore, there is no need to provide a front end edge guide for guiding front ends of the media M1 in the discharge direction −Y. In addition, the stacker 24 has the tilting posture, and thereby it is possible to relatively shorten the stacker 24 in length in the discharge direction −Y, which is required for mounting the medium M1 having a predetermined length on the receiving surface 24A, compared to a case of a non-tilting posture (for example, a horizontal posture). Therefore, it is possible to shorten the stacker 24 in length in the discharge direction −Y in proportion to the length of the medium M1 that the stacker 24 is capable of receiving. The discharge direction −Y is a direction on a side opposite to the feed direction Y.

In addition, as illustrated in FIG. 1, the recessed portion 13 is partitioned into a first space 133 and a second space 134 in the vertical direction Z by the stacker 24 disposed above the supply tray 23. The first space 133 is used as a mounting space in which the medium M is mounted on the supply tray 23, and the second space 134 is used as a mounting space in which the recorded medium M1 discharged from the discharge port 29 is mounted on the stacker 24.

As illustrated in FIGS. 1 and 2, the supply tray 23 and the stacker 24 are disposed at a position at which the supply tray and the stacker each have at least an overlap part in the vertical direction Z in the recessed portion 13. As illustrated in FIG. 2, when the recording apparatus 11 is viewed horizontally from front, the supply tray 23 and the stacker 24 are in a positional relationship in which the mounting surface 23A (that is, a disposition region TA of the mounting surface 23A) of the supply tray 23 includes a projection region PA1 of the receiving surface 24A, which is obtained in a case where the receiving surface 24A of the stacker 24 is projected on the mounting surface 23A of the supply tray 23 in the vertical direction Z. In other words, when the recording apparatus 11 is viewed horizontally from front, the supply tray 23 and the stacker 24 overlap each other in the vertical direction Z in the positional relationship in which the projection region PA1 of the receiving surface 24A is included in the disposition region TA of the mounting surface 23A.

In the example illustrated in FIG. 1, the supply tray 23 and the stacker 24 are both entirely disposed in the recessed portion 13, and a ratio of an amount of overlap of one to the other in the vertical direction Z is 80% or higher. Specifically, when one of the supply tray 23 and the stacker 24 is projected on the other in the vertical direction Z, an occupying dimension ratio of a projection portion of the one to the other in a length in the feed direction Y is 80% or higher, for example. In addition, the supply tray 23 and the stacker 24 do not only project to the outside (right side in FIG. 1) from the second opening 132 of the right-side surface with respect to the housing 12, but also do not project to the outside (forward side in FIG. 1) from the first opening 131 of the front surface. In addition, one of the supply tray 23 and the stacker 24 occupies 80% or more portion of the other, for example, even in a projection area obtained by projecting the one on the other in the vertical direction Z. In the example in FIG. 1, the one is the stacker 24, and the other is the supply tray 23. A configuration in which the one is the supply tray 23 and the other is the stacker 24 may be employed.

As illustrated in FIGS. 1 and 2, in the recording apparatus 11, the supply tray 23 and the stacker 24 are disposed in the recessed portion 13 provided to be recessed above the cassette 22 in the housing 12. In other words, the cassette 22 is accommodated below the supply tray 23 and at a position at which the cassette overlap both of the supply tray 23 and the stacker 24 in the vertical direction Z in the housing 12. As described above, the cassette 22, the supply tray 23, and the stacker 24 are disposed at an overlap position in the vertical direction Z. In this manner, an installation space for the recording apparatus 11 is not only reduced, the user can unify handling positions at which work such as setting the medium M on the cassette 22 and the supply tray 23 and taking out of the recorded medium M1 from the stacker 24 to the front surface of the recording apparatus 11 when the user operates the operation panel 14. Therefore, the user can perform various types of work such as the operation of the operation panel 14, the setting of the medium M, and the taking out of the recorded medium M1 from the front surface of the recording apparatus 11, and thus better usability is obtained when the user performs various types of work. In addition, the user can collectively set a space for performing the various types of work to the front surface of the recording apparatus 11, and thus there is no need to secure a work space on both sides of the recording apparatus 11. This contributes to a reduction in occupied space of the recording apparatus 11.

In addition, as illustrated in FIGS. 1 and 2, the under surface 31A of the scanner main body 31 forms a top surface (upper inner wall surface) of the recessed portion 13. In this manner, the main body 31, the supply tray 23, and the stacker 24 overlap each other in the vertical direction Z. As illustrated in FIG. 2, PA2 represents a projection region of the mounting surface 23A, which is obtained in a case where the corresponding mounting surface 23A of the supply tray 23 is projected on the under surface 31A (a virtual plane including the under surface 31A) of the scanner main body 31 in the vertical direction Z. When the recording apparatus 11 is viewed horizontally from front, the supply tray 23 and the scanner main body 31 are in a positional relationship in which the projection region PA2 of the mounting surface 23A is included in the under surface 31A (that is, a disposition region SA of the under surface 31A) of the scanner main body 31. In other words, when the recording apparatus 11 is viewed horizontally from front, the supply tray 23 and the scanner main body 31 overlap each other in the vertical direction Z in the positional relationship in which the projection region PA2 of the mounting surface 23A is included in the under surface 31A (that is, the disposition region SA) of the scanner main body 31. In addition, when the recording apparatus 11 is viewed horizontally from front, PA3 represents a projection region of the receiving surface 24A, which is obtained in a case where the receiving surface 24A of the stacker 24 is projected on the under surface 31A of the scanner main body 31 in the vertical direction Z. When the recording apparatus 11 is viewed horizontally from front, the supply tray 23, the stacker 24, and the scanner main body 31 overlap each other in the vertical direction Z in a positional relationship in which the disposition region SA of the under surface 31A includes both of the projection region PA2 of the mounting surface 23A and the projection region PA3 of the receiving surface 24A. Further, when the recording apparatus 11 is viewed horizontally from front, the cassette 22 and the scanner main body 31 overlap each other in the vertical direction Z in a positional relationship in which a projection region (not illustrated) of the cassette 22, which is obtained in a case where the cassette 22 is projected on the under surface 31A of the scanner main body 31 in the vertical direction Z, is also included in the under surface 31A (that is, the disposition region SA of the under surface 31A.

A total length of the supply tray 23 and the stacker 24 in the feed direction Y is set to an equal dimension (total dimension) of the medium M having the maximum size, which is expected with respect to the recording apparatus 11, in a longitudinal direction or to a slightly longer value than the maximum size. In a model in which the maximum size of the medium M, which is expected with respect to the recording apparatus 11, is A4 size, for example, a length of the supply tray 23 and the stacker 24 in the feed direction Y is equal to the total dimension (297 mm) of the A4-size medium M or is slightly longer than the total dimension. In addition, in a model in which the maximum size of the medium M, which is expected with respect to the recording apparatus 11, is A3 size, for example, a length of the supply tray 23 and the stacker 24 in the feed direction Y is equal to the total dimension (420 mm) of the A3-size medium M or is slightly longer than the total dimension.

Therefore, the medium M on the supply tray 23 and the recorded medium M1 on the stacker 24 do not extend outside from the recording apparatus 11, and there is no need to unfold a medium mounting surface like a telescopic tray or a retractable tray. Accordingly, there is no need to secure a space of an extending portion of the medium M or M1 on the right side of the housing 12 or an unfolding space of the telescopic tray or the retractable tray. In addition, the supply tray 23 and the stacker 24 are disposed in the recessed portion 13 and are in a state in which the medium M and the recorded medium M1 to be mounted are mountable regardless of whether the supply tray and the stacker are used or not. Therefore, there is no need to perform unfolding work at the time of use, which is necessary for the case of the telescopic tray and the retractable tray.

In addition, even when the medium M remains as is set on the supply tray 23, the upper side of the supply tray is covered with the stacker 24, and thus the dust is unlikely to be accumulated on the medium M on the supply tray 23. However, the upper side of the supply tray 23 is covered with the image reading device 30 even when the stacker 24 is not present, and thus a certain dust accumulation preventive effect is achieved. However, the plate-shaped stacker 24 is present in a space between the supply tray 23 and the image reading device 30, and thereby the dust accumulation preventive effect is more enhanced, compared to a configuration in which the supply tray is covered with only the image reading device 30.

Incidentally, in a case where the user accesses the supply tray 23 via the openings 131 and 132 from the front of the recording apparatus 11, the edge guide 25, which is upright on the forward side more than the mounting surface 23A on the supply tray 23, interferes with the access. Therefore, the edge guide 25 is configured to be retracted to a retraction position at which the edge guide not only moves in the width direction X in which the medium M is guided, but also does not interfere with the setting work of mounting the medium M on the mounting surface 23A. In other words, the edge guide 25 is configured to be movable between a guide position illustrated in FIG. 3, at which the medium M can be guided in the width direction X intersecting with the supply direction, and the retraction position at which projecting length of the edge guide 25 through the first opening 131 is smaller than that at the guide position. In the embodiment, the edge guide 25 is configured to be also movable in a direction (upward-downward direction) intersecting with the mounting surface 23A, and thus it is possible to switch between disposed positions of the edge guide between the guide position illustrated in FIG. 3 and the retraction position illustrated in FIG. 4. If the edge guide 25 is retracted from the guide position (FIG. 3) to the retraction position (FIG. 4) when the user sets the medium M, a wider work passage is secured to be used when the medium M is set on the mounting surface 23A via the first opening 131 from the front of the recording apparatus 11. A detailed configuration of a retracting mechanism 70 (refer to FIG. 7) that moves the edge guide 25 from the guide position to the retraction position will be described below.

Figure 3:
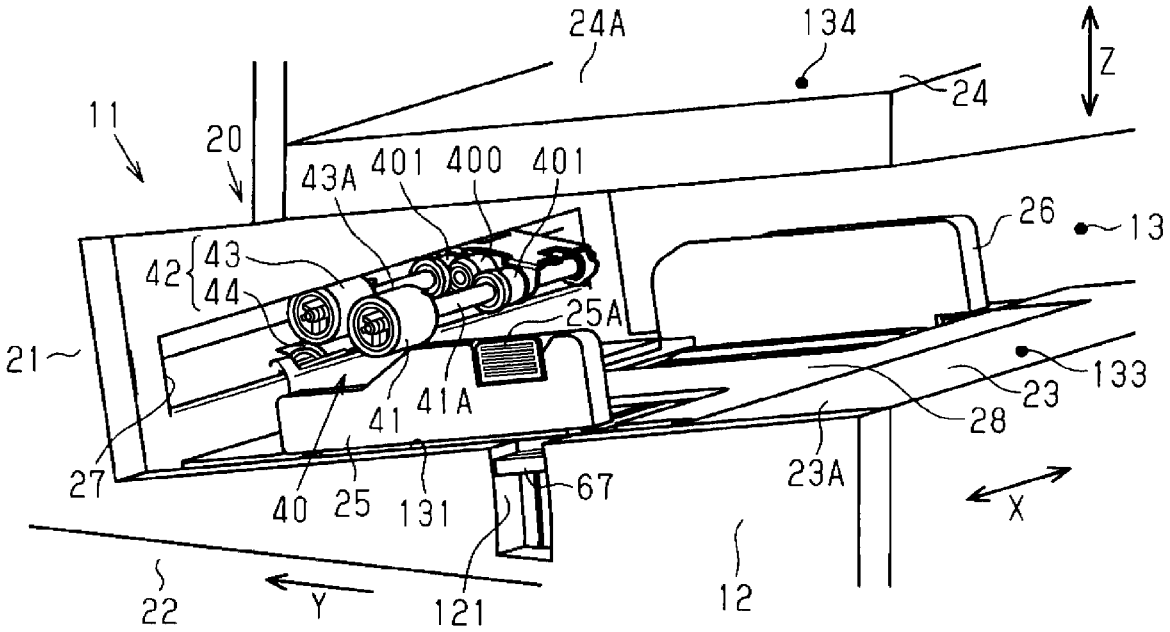
FIG. 3 is a perspective view schematically illustrating a supply tray in a state in which an edge guide is disposed at a guide position.

As illustrated in FIGS. 1 and 3, the feed port 27 is open in a wall surface (right-side surface) of the printing function unit 21 which faces the recessed portion 13. The supply tray 23 is disposed on a slightly lower side of the feed port 27 and has an upper surface provided with a plate-shaped hopper 28 that can push up the medium M set on the mounting surface 23A. The hopper 28 has a plate member having a substantially H shape as illustrated in FIG. 1 and is movable upward and downward around a rotation shaft 28A (refer to FIG. 5) which is positioned on an upstream end the hopper in the feed direction Y. The hopper 28 is biased upward due to an elastic force of a spring 69 (refer to FIG. 7) and moves upward and downward between a standby position illustrated in FIG. 3 via a lifting/lowering mechanism (not illustrated) by power from a feed motor 410 (refer to FIG. 5) or a dedicated electric motor and a feed position (lifting position) at which the medium M on the hopper 28 is able to abut a pickup roller 41 of a first feed unit 40.

As illustrated in FIGS. 1 to 3, the first feed unit 40 as an example of a first supply unit that supplies the medium M on the supply tray 23 from the feed port 27 into the printing function unit 21 is provided at a position in the vicinity of the feed port 27 in the housing 12. The first feed unit 40 includes the pickup roller 41 with which the medium M on the hopper 28 comes into press contact when the hopper 28 is lifted to the feed position and a separating mechanism 42 that is positioned next to the pickup roller 41 on the downstream side in the feed direction Y. In the example illustrated in FIGS. 2 and 3, the separating mechanism 42 includes a feed roller 43 and a separation roller 44 (retard roller). The separating mechanism may belong to a bank separation type, instead of the roller separation type described above. The bank separation-type separating mechanism includes a separation portion (bank portion) which has an inclined friction surface that is provided to be upright at a predetermined inclination angle with respect to the feed direction Y and the separating mechanism feeds the medium M along the inclined friction surface. In this manner, one medium M to be fed is separated from the other medium by using the friction and an angle of the separating unit.

Figure 5:
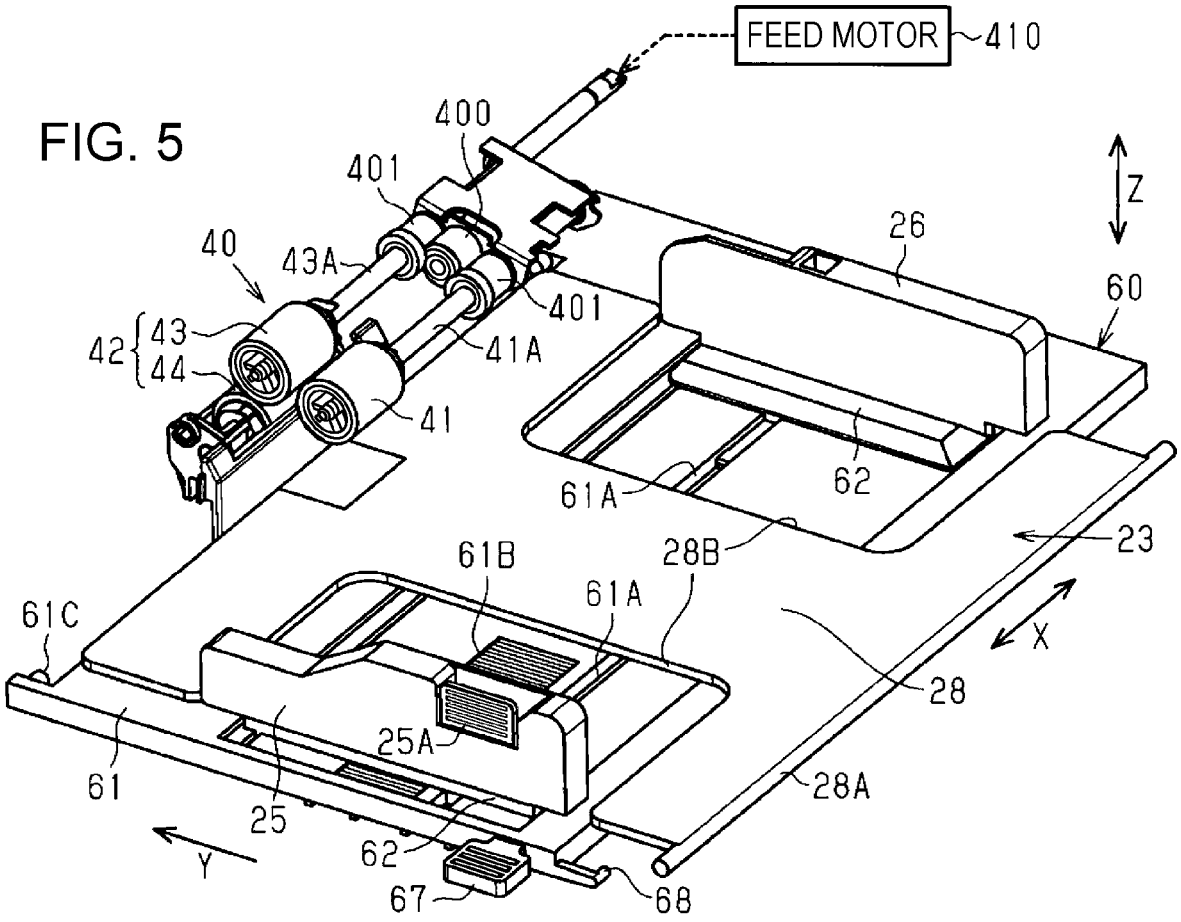
FIG. 5 is a perspective view schematically illustrating a configuration of the supply tray.

When the holding mechanism of the lifting/lowering mechanism is released by power of a power source, the hopper 28 illustrated in FIGS. 2 and 5 is lifted from the standby position due to the bias force of the spring 69 (FIG. 7), reaches a feed position at which the medium M on the supply tray 23 comes into press contact with the pickup roller 41, is lowered from the supply position against a bias force of the spring 69 by the power of the drive source, and returns to the standby position illustrated in FIG. 3. During the printing start, the hopper 28 is lifted, and the medium M on the supply tray 23 comes into press contact with the pickup roller 41 from the lower side. In this state, the pickup roller 41 is rotatably driven, and thereby the uppermost medium of the media M on the supply tray 23 is fed. Even though a plurality of media M sent out by the pickup roller 41 are fed (double fed), one medium is separated by using a difference in the friction force of the two rollers 43 and 44 constituting the separating mechanism 42.

As illustrated in FIG. 3, the pickup roller 41 and the feed roller 43 are connected in a state in which the rollers is capable of transmitting power to and from the feed motor 410 via a power transmitting mechanism 400 having gears 401 provided on rotation shafts 41A and 43A. In addition, when the operation unit 25A provided in an upper end portion of the edge guide 25 is pushed and operated, the edge guide 25 is movable in the width direction X. When the pushing operation of the operation unit 25A is canceled, the edge guide 25 is locked to a position.

As illustrated in FIG. 1, on a wall surface facing the recessed portion 13 of the printing function unit 21, a discharge port 29 is open at a position (position on the upper side in the example in FIG. 1) which is different from the feed port 27 in the vertical direction Z. The stacker 24 is disposed at a height position below the position (specifically, a nip position between a discharge roller pair 57 in FIG. 3) of the discharge port 29.

As illustrated in FIG. 2, a second feed unit 45 is disposed at a position in the vicinity of the upper side of a downstream-side end portion of the cassette 22 in the feed direction Y, and the second feed unit is an example of a second supply unit that supplies the plurality of media M accommodated in the cassette 22 one by one in an order from the uppermost medium. The second feed unit 45 has the same configuration as that of the first feed unit 40 and includes a pickup roller 46 that feeds the medium M and a separating mechanism 47 that is positioned next to the pickup roller 46 on the side of the feed direction Y. In the example illustrated in FIG. 2, the separating mechanism 47 belongs to the roller separation type and includes a feed roller 48 and a separation roller 49 (retard roller). The separating mechanism 47 may also belong to the bank separation type.

As illustrated in FIG. 2, the medium M in the cassette 22 is mounted on the mounting plate 22B, and the mounting plate 22B is biased upward in the vertical direction Z. In this manner, the medium M on the mounting plate 22B comes into press contact with the pickup roller 46. During the printing start, when the pickup roller 46 and the feed roller 48 are rotatably driven by the drive of a drive source of the second feed unit 45, the media M in the cassette 22 are fed one by one in order from the uppermost medium. One medium M sent out by the pickup roller 46 is separated by using the friction force of the two rollers 48 and 49 constituting the separating mechanism 47 and is fed into the printing function unit 21. The drive source of the two feed units 40 and 45 is the feed motor 410 (refer to FIG. 5); however, a configuration in which, instead of the feed motor, a transport motor (not illustrated) which is a drive source of a transport unit 51 to be described below is used, and the transport unit 51 and the feed units 40 and 45 have a common drive source may be employed.

As illustrated in FIG. 2, a printing mechanism 50 that performs the transport of the medium M and the printing (recording) on the medium M is accommodated in the printing function unit 21. The printing mechanism 50 includes the transport unit 51 that transports the medium M fed from the cassette 22 and the supply tray 23 along a transport passage 52 illustrated in FIG. 2 from the feed port 27 to the discharge port 29. The transport unit 51 includes a plurality of roller pairs 53.

A recording unit 54 that performs printing (recording) on the supplied medium M is provided at a position in the middle of the transport passage 52. The recording unit 54 includes a line head that is capable of ejecting an ink over the medium M in the width direction X. The recording unit 54 is not limited to a line recording method of performing recording on a width of one row at once by the line head, and the recording unit may employ a serial recording method in which a recording head is provided in a carriage that is movable in the width direction X and the recording on a width of one row is performed by ejecting an ink from the recording head during a moving process of the carriage. In addition, a position and a disposed angle of the recording unit 54 is not limited to the example in FIG. 2 and may be appropriately modified.

As illustrated in FIG. 2, a support base 55 that supports the medium M is disposed at a position on a side opposite to the recording unit 54 with the transport passage 52 interposed therebetween. The support base 55 holds the medium M at a position with a predetermined gap to the recording unit 54. The plurality of roller pairs 53 constituting the transport unit 51 include a set of transport roller pair 56 that transports the medium M at positions on both sides (the upstream side and the downstream side) with the recording unit 54 interposed therebetween in a transport direction Y. In addition, the plurality of roller pairs 53 include the discharge roller pair 57 that discharges the recorded medium M1 obtained after the recording from the discharge port 29. In addition, in the example illustrated in FIG. 2, the feed direction Y in which the feed units 40 and 45 send out the medium M is the same as the transport direction of a portion of the medium M that is transported on the support base 55, which is opposite to the recording unit 54. Therefore, in the embodiment, there is a case where the transport direction of the medium M in a recording process in the recording unit 54 is pointed to be referred to as the "transport direction Y".

The transport passage 52 includes a supply passage 521 through which the medium M from the supply tray 23 is fed to a recording position that is opposite to the recording unit 54 and a supply passage 522 through which the medium M from the cassette 22 is fed to the recording position that is opposite to the recording unit 54. In addition, the transport passage 52 includes a reverse transport passage 523 as an example of a reverse transport route in which the recorded medium M1 obtained after the recording performed by the recording unit 54 is reversed and is transported toward the discharge port 29. Further, the transport passage 52 includes a reverse passage 524 which is a route in which the medium M that has been subjected to recording on one surface is reversed while being reversely transported in a case of duplex recording, is returned to the upstream side of the recording unit 54, and is fed to the recording unit 54 again. For example, the transport unit 51 may include a transport belt that transports the medium M. In this case, it is preferable that the transport belt be configured to circle around in a state of holding the medium M by electrostatic adsorption of the medium M on an outer circumferential surface of the transport belt.

As illustrated in FIG. 2, the downstream end of the medium M in the feed direction Y which is mounted on the supply tray 23 is positioned on the upstream side in the feed direction Y more than the downstream end of the medium M in the feed direction Y which is accommodated on the cassette 22. In other words, when viewed vertically from above in the vertical direction Z, the downstream end of the medium M in the feed direction Y which is accommodated in the cassette 22 is positioned to be closer to the side of the recording unit 54 than the downstream end of the medium M in the feed direction Y which is mounted on the supply tray 23. Therefore, the second feed unit 45 for the cassette 22 is positioned to be closer to the side of the recording unit 54 in the feed direction Y than the first feed unit 40 for the supply tray 23. In this manner, the first feed unit 40 and the second feed unit 45 are disposed in a state in which at least a part of each of the first feed unit and the second feed unit is positioned at the same height as each other in the vertical direction Z. In the example illustrated in FIG. 2, the separation roller 44 constituting the first feed unit 40 and the feed roller 48 constituting the second feed unit 45 are disposed in a state the units each have a part that is positioned at the same height as each other in the vertical direction Z. In other words, the first feed unit 40 and the second feed unit 45 each have a part of overlapping in a horizontal direction, and the cassette 22 and the supply tray 23 are disposed to be relatively closer in the vertical direction Z due to the overlap. In this manner, the height of the recording apparatus 11 is reduced to be relatively low. As illustrated in FIG. 2, the pickup roller 41 that feeds the medium M on the supply tray 23 in the feed direction Y is positioned on the downstream side from the discharge port 29 in the feed direction Y. In other words, in a case of being viewed vertically, the pickup roller 41 is closer to the recording unit 54, of the pickup roller 41 and the discharge port 29.

In addition, as illustrated in FIG. 2, in the recording apparatus 11, the supply tray 23 and the cassette 22 supply the medium M to the recording unit 54 without reversing of the medium through the respective supply passages 521 and 522 and discharges the recorded medium M1 (refer to FIG. 1) subjected to the recording on the upper surface to the stacker 24 from the discharge port 29 with the recording surface facing downward by reversing the medium in the reverse transport passage 523. Therefore, the supply tray 23 and the cassette 22 have the media that have the same orientation (upward orientation in the example) of the recording surface when the media M are set, and thereby it is possible to reduce mistakes of erroneously mounting the front and the back of the medium M when the media M are set. In other words, when the user is aware that the recording is performed on the same surface (upper surface in the example) of the medium M in the orientation that is set always, it is difficult to mistake the orientation of the front and back in which the medium M is set. Accordingly, recording errors of mistaking the recording surface due to the mistakes of the orientation in which this type of medium M are reduced. For example, it is possible to reduce misprinting of printing on a wrong surface during the printing on the medium M such as preprinted paper or the like for a postcard or trial printing.

As illustrated in FIG. 2, an ink containing unit 58 is provided at a position between the reverse transport passage 523 and the image reading device 30 in the housing 12. A plurality of (4 in the example in FIG. 2) ink containing portions 59 (for example, ink cartridges or ink tanks) in which inks are contained, are attached to the ink containing unit 58 in a detachable state. The plurality of ink containing portions 59 contains respective different color inks. For example, the ink containing portions 59 each contain one color ink of a plurality of color inks including black (K), cyan (C), magenta (M), and yellow (Y). In the example in FIG. 2, four ink containing portions 59 corresponding to four colors (KCMY) are illustrated; however, ink containing portions 59 corresponding to other colors such as light cyan, light magenta, light yellow, gray, green, and violet may be added, for example.

As illustrated in FIG. 2, of the transport passage 52 in the housing 12, an ink supply unit 35 and a maintenance device 36 are disposed in an aligned manner in the vertical direction Z in a region which is the inside of a route through which the recorded medium M1 obtained after the recording is performed on the medium M supplied from the feed port 27 is transported to the discharge port 29 while the medium is reversed. The ink supply unit 35 is interposed in the middle of an ink tube (not illustrated) that connects the ink containing portions 59 and the recording unit 54 and has a function of supplying the ink from the ink containing portions 59 to the recording unit 54. The recording unit 54 ejects the color inks supplied through an ink tube (not illustrated) from the ink containing portion 59 by the ink supply unit 35 and performs the recording on the medium M. The maintenance device 36 performs maintenance such as cleaning of nozzles for preventing or eliminating clogging or the like of the ink ejecting nozzles provided in the recording unit 54.

Figure 6:
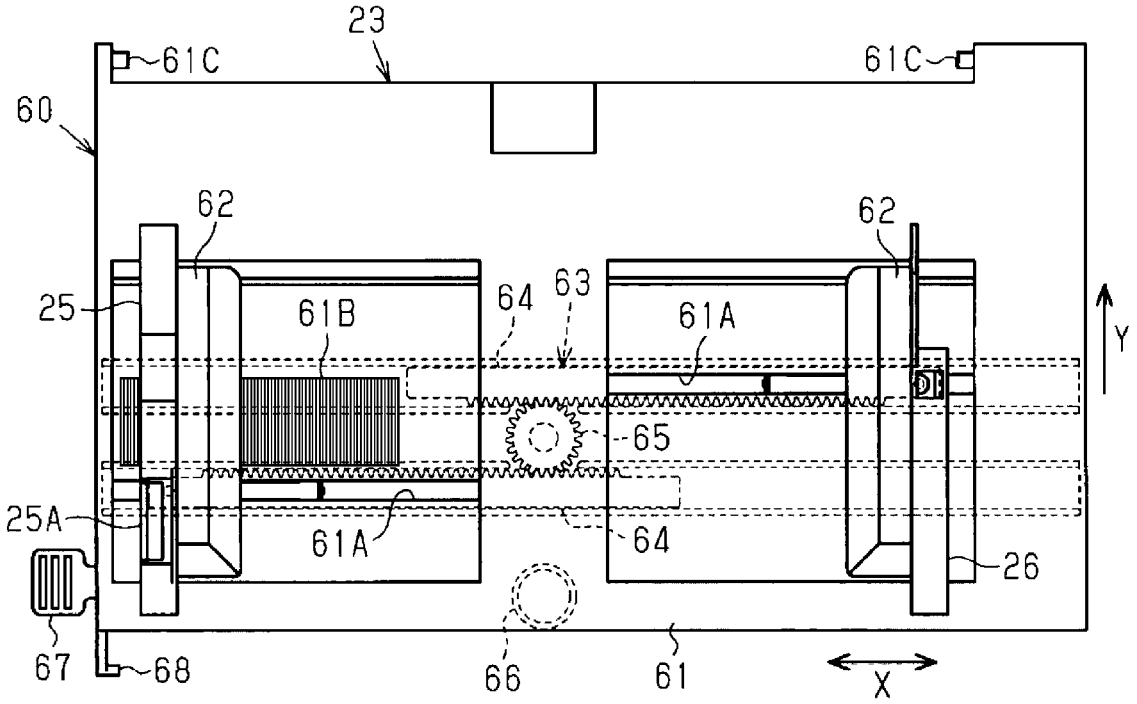
FIG. 6 is a plan view schematically illustrating the configuration of the supply tray.

As illustrated in FIGS. 5 and 6, the supply tray 23 includes a mounting mechanism 60 that supports the pair of edge guides 25 and 26 in a slidable manner in the width direction X. The mounting mechanism 60 is disposed below the hopper 28 and has a quadrangular plate-shaped support plate 61 that supports the pair of edge guides 25 and 26 in a movable manner in the width direction X. The hopper 28 is provided with a pair of cutout recesses 28B in which interference with the edge guides 25 and 26 is avoided over a movable range of the pair of edge guides 25 and 26. The pair of edge guides 25 and 26 each extends perpendicularly upward from the upper surface of the pair of base portions 62 which is slidable on the support plate 61. The pair of base portions 62 supports the edge guides 25 and 26 in a movable manner in the width direction X, and a part of the medium M guided by the pair of edge guides 25 and 26 is mounted on a part of the upper surface. The pair of base portions 62 is guided along long guide grooves 61A extending in the width direction X which are open in the support plate 61 and is provided to be movable in the width direction X via a sliding mechanism 63 illustrated in FIG. 6 which is assembled on a side of a back surface of the support plate 61. Therefore, the pair of edge guides 25 and 26 which is supported by the pair of base portions 62 is movable in the width direction X via the sliding mechanism 63.

As illustrated in FIG. 6, the sliding mechanism 63 includes a pair of racks 64 extending in directions opposite to each other from the pair of edge guides 25 and 26, respectively, and one pinion 65 with which teeth portions formed on both of the pair of racks 64 in the longitudinal direction are commonly mesh. The pair of racks 64 meshes with teeth portion on an outer circumference so as to pinch the pinion 65 from both sides. When one of the pair of edge guides 25 and 26 is moved in a direction of shortening a gap between both guides, the pair of edge guides 25 and 26 moves in an approaching direction by the same length in the link with each other via the meshing between the racks 64 and the pinion 65. In addition, when one of the pair of edge guides 25 and 26 is moved in a direction of lengthening the gap between both guides, the pair of edge guides 25 and 26 moves in a separating direction by the same length in the link with each other via the meshing between the racks 64 and the pinion 65. Therefore, the pair of edge guides 25 and 26 positions the medium M on the supply tray 23 at the center position at which the width center of the medium is coincident with the center of the supply tray 23 regardless of the size of the medium.

As illustrated in FIGS. 5 and 6, a locking target portion 61B having an uneven shape at a constant pitch is provided in a predetermined region in the vicinity of the edge guide 25 on the upper surface of the support plate 61, and a movable locking portion (not illustrated) that is linked with the operation unit 25A is provided on an under surface of the base portion 62 of the edge guide 25. When the locking between the locking portion and the locking target portion 61B is canceled by the operation of the operation unit 25A, the width between the pair of edge guides 25 and 26 is adjusted, and then the operation of the operation unit 25A is stopped, the locking portion and the locking target portion 61B are locked, and the pair of edge guides 25 and 26 are locked at the position.

As described above, when the medium M is set on the supply tray 23 and the stacker 24 in the recessed portion 13 from the front of the recording apparatus 11, the edge guide 25 on the forward side interferes with the setting when viewed from the first opening 131. In the embodiment, the edge guide 25 is configured to be retractable, and thereby operability from the front of the recording apparatus 11 improves. Hereinafter, an example of a configuration of the retracting mechanism 70 of the edge guide 25 will be described.

As illustrated in FIGS. 5 and 6, the support plate 61 constituting the supply tray 23 is provided with a pair of rotation shafts 61C, which projects in directions of facing each other, on both end portions in the width direction X in the downstream end portion in the feed direction Y. The pair of rotation shafts 61C is supported to be rotatable in a portion that is positioned slightly lower than the feed port 27 of the housing 12, and thereby the support plate 61 is rotatable around the pair of rotation shafts 61C within a predetermined angle range.

Figure 9:
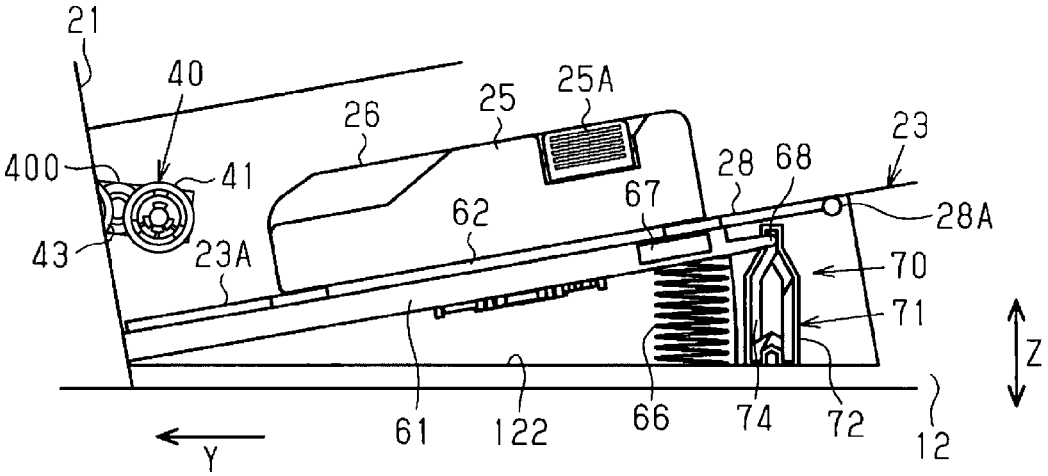
FIG. 9 is a side view schematically illustrating a state in which the edge guide is disposed at the guide position.

As illustrated in FIGS. 6 and 9, the support plate 61 is in a state of being biased upward by a spring 66 provided to be interposed between an upstream-side end portion of the support plate in the feed direction Y and a support surface 122 that is positioned on a back side (lower side) of the support plate. Therefore, the support plate 61 is biased such that the upstream-side end portion is displaced upward around the rotation shaft 61C (refer to FIG. 6) on a downstream-side end portion thereof in the feed direction Y. The pair of edge guides 25 and 26 supported by the support plate 61 is lifted by a bias force of the spring 66 to a guide position illustrated in FIGS. 3 and 7 which projects upward from the upper surface of the hopper 28 such that the medium M can be positioned in the width direction X.

Figure 7:
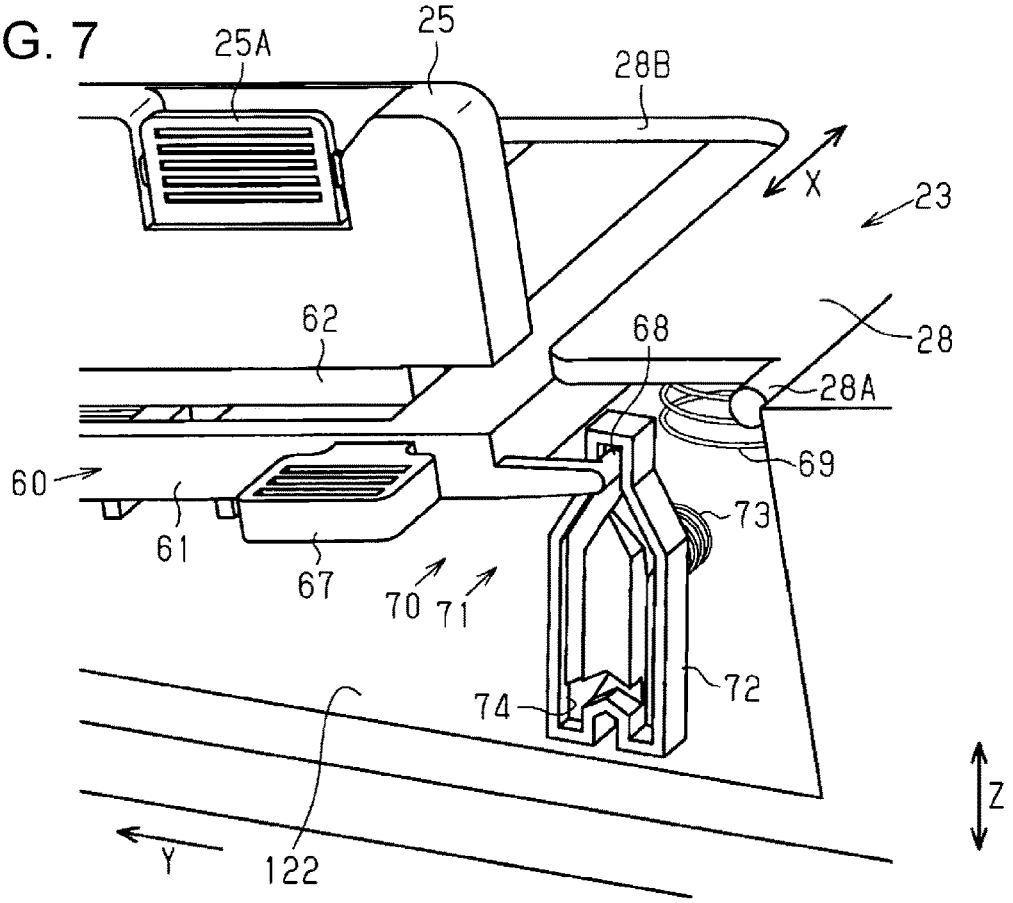
FIG. 7 is a perspective view illustrating a moving mechanism of the edge guide.

As illustrated in FIGS. 5 and 7, an operation lever 67 extends to the outside in the horizontal direction on the upstream-side end portion in the feed direction Y on a side surface on the front side of the support plate 61. In addition, a camshaft 68 projects in an orientation in which the axial center of the shaft is parallel with the rotation shaft 28A of the hopper 28, on the upstream-side end portion which is a position on the upstream side from the operation lever 67 in the feed direction Y in the support plate 61.

Figure 4:
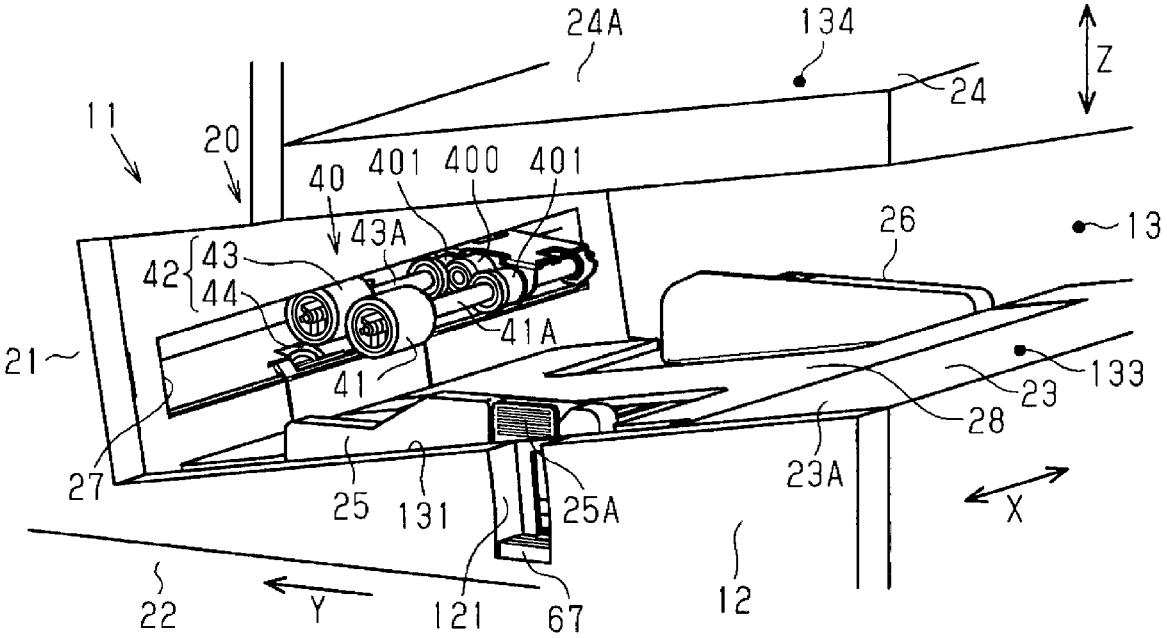
FIG. 4 is a perspective view schematically illustrating the supply tray in a state in which the edge guide is disposed at a retraction position.

As illustrated in FIGS. 3 and 4, the operation lever 67 is disposed at a position in the vicinity of the lower side of the edge guide 25 on the front of a portion which is the lower side of the recessed portion 13 in the housing 12. The operation lever 67 is movable upward and downward (in the vertical direction Z) along a guide recess 121 provided to be recessed and to be vertically elongated in the vertical direction Z in the housing 12.

The operation lever 67 is operated by the user so as to move the edge guide 25 to the guide position and the retraction position. The user pushes the operation lever 67 on the front of the recording apparatus 11 to the lower side, and thereby it is possible to move the edge guide 25 to the retraction position at which a part of the edge guide enters the mounting surface 23A. In other words, the operation lever 67 is pushed to the lower side, and thereby the edge guide 25 moves to the retraction position at which the portion of the edge guide projecting upward more than the mounting surface 23A is smaller than that at the guide position.

Here, in a state in which the edge guide 25 is disposed at the guide position illustrated in FIG. 3, a first area is a projection area obtained by projecting, in the width direction X, the portion of the edge guide 25 which projects upward more than the mounting surface 23A on a virtual plane orthogonal to the width direction X. In addition, in a state in which the edge guide 25 is disposed at the retraction position illustrated in FIG. 4, a second area is a projection area obtained by projecting, in the width direction X, the portion of the edge guide 25 which projects upward more than the mounting surface 23A on the virtual plane. The second area which is the projection area obtained when the edge guide 25 is disposed at the retraction position is smaller than the first area which is the projection area obtained when the edge guide 25 is disposed at the guide position (first area>second area). The projection area at this time corresponds to an occupied area occupied by the edge guide 25, which cannot be used as a work passage in which the user sets the medium M, of an opening area of the opening 131 that can be used when the user mounts (sets) the medium M on the mounting surface 23A of the supply tray 23 via the opening 131 from the front side of the recording apparatus 11. Therefore, the edge guide 25 is displaced downward from the guide position at which the projection area is the first area such that the position is switched to the retraction position at which the projection area is the second area smaller than the first area, and thereby a wide work passage, in which the edge guide 25 does not interfere with the setting when the medium M is set from the front of the recessed portion 13, is secured.

As illustrated in FIG. 7, the retracting mechanism 70 includes a holding mechanism (locking mechanism) that is capable of holding (locking) the edge guide 25 at the retraction position. In the example, a heart cam mechanism 71 is employed as an example of the holding mechanism. When the heart cam mechanism 71 pushes down the edge guide 25 by using the operation lever 67, the edge guide 25 is held (locked) at the retraction position.

The medium M is fed in a way that the hopper 28 is lifted by the drive of the feed motor 410 (refer to FIG. 5) or a motor (not illustrated) and the spring 69 interposed between the support surface 122 and the support plate 61 of the housing 12 illustrated in FIG. 7 and the medium M on the hopper 28 is controlled to be disposed at a switched position from a position at which the medium is separated from the pickup roller 41 to a position at which the medium abuts the pickup roller 41. Here, even when the user operates the operation lever 67 so as to cause the edge guide 25 to be retracted to the retraction position, it is difficult to perform setting work of the medium M on the hopper 28 when the hopper 28 is lifted. Therefore, the control unit 100 causes a sensor (not illustrated) to detect a position of the edge guide 25 which changes by the retracting mechanism 70 and controls the position of the hopper 28 in association with the operation of the edge guide 25 based on the detection results. When the user causes the edge guide 25 to be retracted to the retraction position, and if the hopper 28 is disposed at the feed position at that time by detecting the retraction, the hopper 28 is moved to the standby position, and thus the user easily performs the setting work of the medium M. Specifically, the control unit 100 separates the hopper 28 from the pickup roller 41 in association with the retracting operation of moving the edge guide 25 from the guide position to the retraction position and, then, the hopper 28 is lifted to the feed position or is in a standby state until there is a printing start instruction in association with an operation of returning the retracted edge guide 25 to the original guide position. Here, a reason for remaining in the standby state until the printing start instruction is input in the latter is because a defect such as bleeding or the like occur when the medium M on the hopper 28 in the standby state is in contact with the pickup roller 41 for a long time.

As illustrated in FIG. 7, the retracting mechanism 70 includes a camshaft 68 provided on the upstream-side end portion of the support plate 61 in the feed direction Y and a heart cam 72 that engages with the camshaft 68. The camshaft 68 extends to the upstream side from the position in the vicinity of the operation lever 67 in the feed direction Y in the support plate 61 and is configured to have a circular cylinder-shaped shaft portion that projects inward in the width direction X from a distal portion (rear end portion) of the camshaft. The heart cam 72 is provided with a cam groove 74 with which the camshaft 68 engages, and the cam groove 74 is formed over the entire circumference along a circumferential edge of the heart cam 72. The camshaft 68 engaging with the cam groove 74 moves by making one rotation along the cam groove 74 in the counterclockwise direction in FIG. 7 in processes in which the edge guide 25 performs a retracting operation and a returning operation, and the camshaft is disposed at a cam position at which the camshaft holds the edge guide 25 at the retraction position when the camshaft is disposed at a locking position in the vicinity of the lower end in the middle of the movement of making one rotation.

In addition, as illustrated in FIG. 7, the heart cam mechanism 71 includes the heart cam 72 and a spring 73 that biases the heart cam 72 from the rear side to one side in the width direction X. The heart cam 72 is pressed to the one side in the width direction X by an elastic force of the spring 73, and thereby the camshaft 68 is movable along the cam groove 74 in a state in which the camshaft is pressed to the bottom surface of the cam groove 74. In the process of operating the operation lever 67 upward and downward, the edge guide 25 is displaced upward and downward between the guide position and the retraction position, and the camshaft 68 is guided along the cam groove 74 of the heart cam 72 in association with the displacement. At this time, the camshaft 68 is disposed at the locking position when the edge guide 25 is disposed at the retraction position, and thereby the edge guide 25 is locked.

Figure 8:
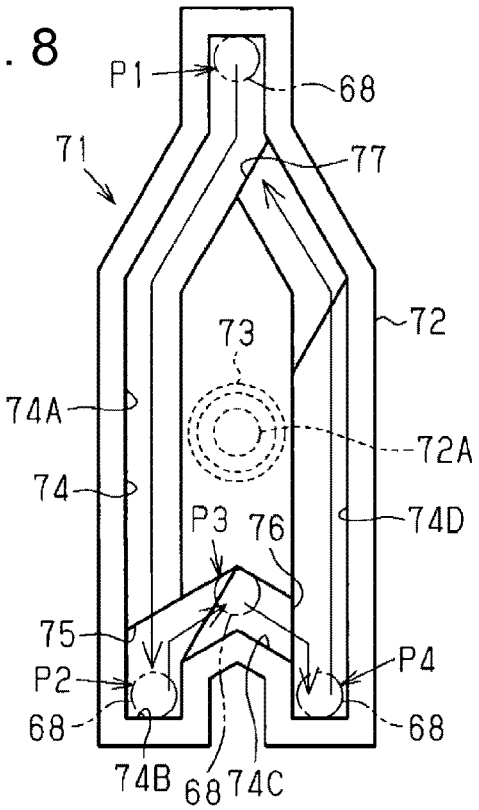
FIG. 8 is a front view illustrating a heart cam.

Next, a configuration of the heart cam 72 will be described in detail with reference to FIG. 8. As illustrated in FIG. 8, the heart cam 72 is biased to the side of the camshaft 68 in the width direction X by the spring 73 into which a shaft portion 72A projecting from the center portion of a rear surface of the heart cam is inserted. The cam groove 74 provided to be recessed in a front surface on a side opposite to the rear surface on the side of the spring 73 of the heart cam 72 has an upper end position which is a starting point of the camshaft 68. When the edge guide 25 is disposed at the guide position, the camshaft 68 is positioned at the starting point. The heart cam 72 is provided with the cam groove 74 that is formed along a route of making one rotation along the circumferential edge of the heart cam 72 from the starting point in the counterclockwise direction in FIG. 8. The cam groove 74 is provided with a first groove portion 74A extending downward from the starting point of the heart cam 72 in the counterclockwise direction and a second groove portion 74B and a third groove portion 74C which form a chevron route along a lower end portion of the heart cam 72. Further, the cam groove 74 is provided with a fourth groove portion 74D that extends upward toward the starting point from the lower end portion on the side (right side in FIG. 8) opposite to the lower end portion of the first groove portion 74A with the second groove portion 74B and the third groove portion 74C interposed therebetween and forms a route which is in the line symmetry with the first groove portion 74A with respect to a width center line of the heart cam 72. The fourth groove portion 74D is connected to the first groove portion 74A at a position that is slightly closer to the lower end than the starting point of the first groove portion 74A. The camshaft 68 engaging with the cam groove 74 makes one rotation along the route in the counterclockwise direction in FIG. 8 from the starting point through the first groove portion 74A, the second groove portion 74B, the third groove portion 74C, and the fourth groove portion 74D in FIG. 8 in a process of a lowering operation in which the edge guide 25 reaches the retraction position from the guide position and a lifting operation in which the edge guide reaches the guide position from the retraction position.

In FIG. 8, the groove of the second groove portion 74B is deeper than the groove of the first groove portion 74A, and a regulation surface 75 that regulates movement (reversing) of the camshaft 68 from the second groove portion 74B to the first groove portion 74A is provided on a boundary between the first groove portion 74A and the second groove portion 74B. In addition, a bottom surface of the second groove portion 74B is formed to have an ascent surface of which a depth of the groove decreases gradually as approaching the third groove portion 74C, and a bottom surface of the third groove portion 74C is formed to have a descent surface of which a depth of the groove increases gradually as approaching the fourth groove portion 74D. A bottom surface of the fourth groove portion 74D is slightly deeper than that of the third groove portion 74C at a position to which a downstream end portion of the third groove portion 74C is connected, and a regulation surface 76 that regulates movement (reversing) of the camshaft 68 from the fourth groove portion 74D to the third groove portion 74C is provided on a boundary therebetween. The bottom surface of the fourth groove portion 74D is formed to have an ascent surface of which a depth decreases gradually as separating from a lower end portion of the fourth groove portion and a descent surface of which a depth increases gradually as approaching the first groove portion 74A from the position at which the ascent surface ends (ridge line). A bottom surface of the first groove portion 74A is slightly deeper than that of the fourth groove portion 74D at a position to which an upper end portion of the fourth groove portion 74D is connected, and a regulation surface 77 that regulates movement (reversing) of the camshaft 68 from the first groove portion 74A to the fourth groove portion 74D is provided on a boundary therebetween.

Figure 10:
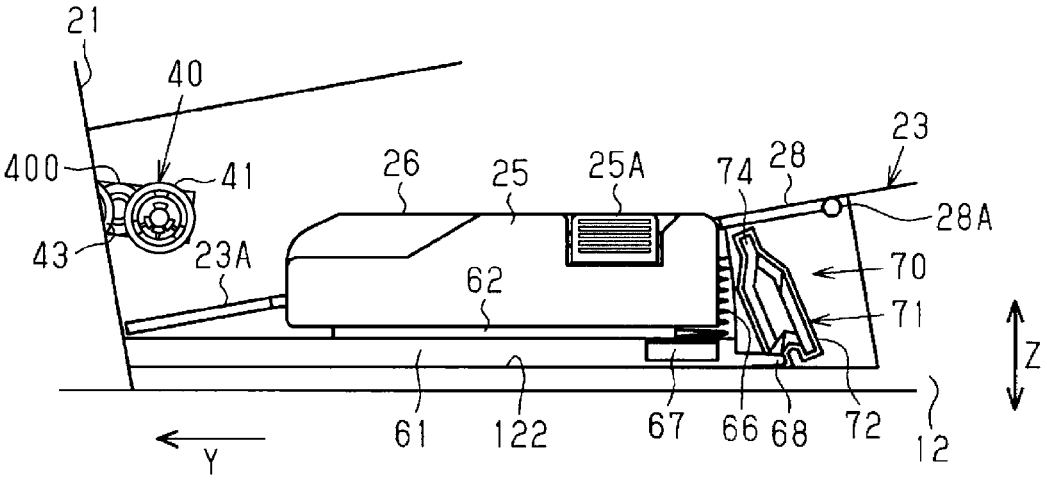
FIG. 10 is a side view schematically illustrating a state in which the edge guide is disposed at the retraction position.
Figure 11:
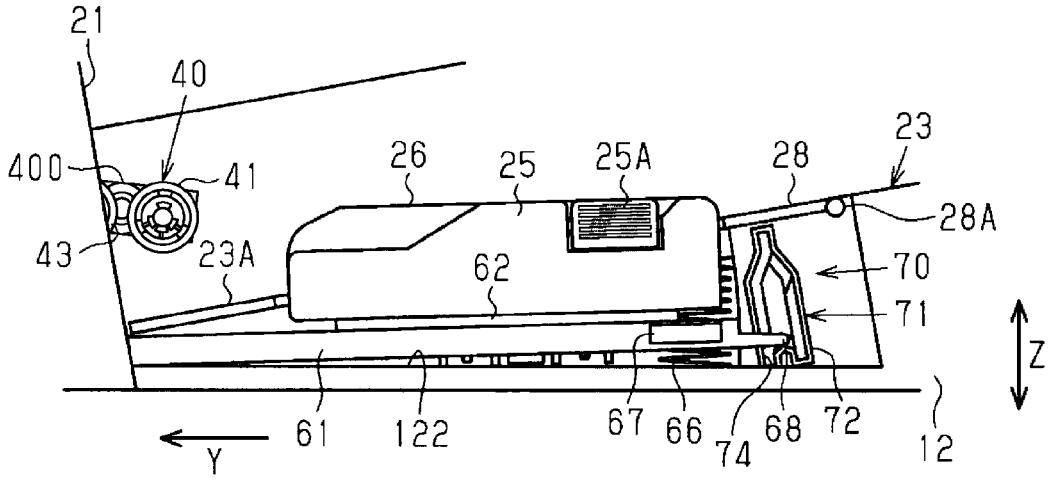
FIG. 11 is a side view schematically illustrating a state in which the edge guide is locked at the retraction position.

As illustrated in FIGS. 7 and 9, when the edge guide 25 is disposed at the guide position, the operation lever 67 is disposed at the first operation position in FIGS. 7 and 9. At this time, the camshaft 68 engaging with the cam groove 74 is positioned at the starting point (a starting position P1 in FIG. 8) on the upper end portion of the heart cam 72. When the user pushes the operation lever 67 downward from the first operation position and the operation lever moves to a second operation position, as illustrated in FIG. 10, the edge guide 25 is pushed down and is disposed at the retraction position from the guide position. At this time, the camshaft 68 reaches the second groove portion 74B (position P2 in FIG. 8) on the lower end from the starting point along the first groove portion 74A. In this process, the heart cam 72 tilts to the side of the edge guide 25 (left side) as illustrated in FIG. 10. When the operation lever 67 is released from the user's hand, the edge guide 25 moves upward by the bias force of the spring 66; however, while reversing is regulated by the regulation surface 75 illustrated in FIG. 8, a length to the locking position P3 along the second groove portion 74B slightly increases. The camshaft 68 is held in a chevron recess at the boundary between the second groove portion 74B and the third groove portion 74C at the locking position P3 (refer to FIG. 8), and the movement of the camshaft upward more from the position is regulated. As a result, as illustrated in FIG. 11, the edge guide 25 is locked at the retraction position.

In this manner, the user causes the edge guide 25 to be retracted at the retraction position, and the user sets the medium M on the supply tray 23 via the work passage secured by the first opening 131. At this time, since the edge guide 25 is held (locked) at the retraction position, there is no need to press and hold the edge guide 25 and the operation lever 67 by hand at the retraction position. Therefore, the user can perform the setting work of setting the medium M on the supply tray 23 with both hands as necessary.

Figure 12:
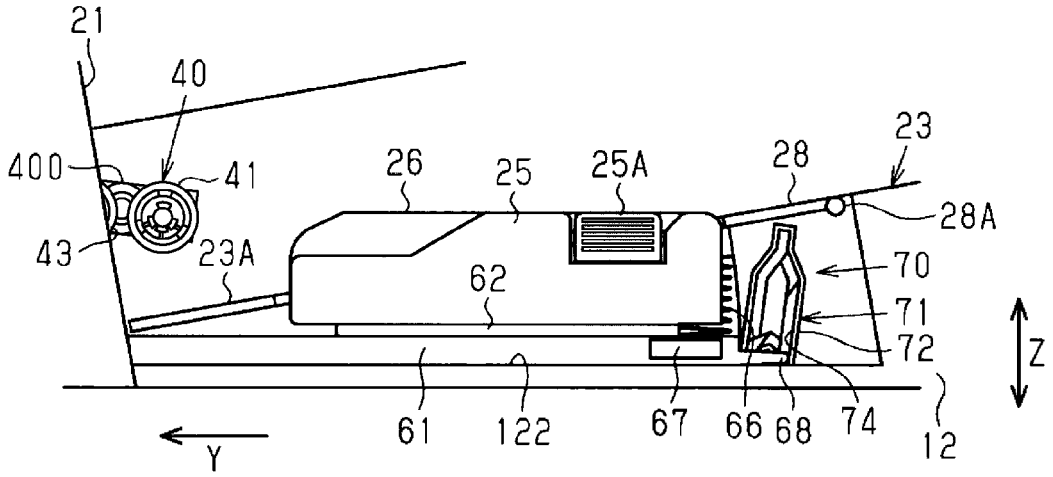
FIG. 12 is a side view schematically illustrating a state in which locking of the edge guide to the retraction position is canceled.

When the user pushes the operation lever 67 again after the setting work of the medium M ends, the camshaft 68 reaches the lower end (position P4 in FIG. 8) of the fourth groove portion 74D from the locking position P3 along the third groove portion 74C, and thereby the locking of the edge guide 25 at the retraction position is canceled. In this process, the heart cam 72 tilts to the side (right side in FIG. 12) opposite to the edge guide 25 as illustrated in FIG. 12. Next, when the pushed operation lever 67 is released from the user's hand, the camshaft 68 is lifted along the fourth groove portion 74D while the regulation surface 76 regulates the reversing from the fourth groove portion 74D to the third groove portion 74C. Then, when the camshaft reaches the first groove portion 74A, the camshaft 68 is lifted along the first groove portion 74A to the upper end thereof and returns to the starting position P1 of the heart cam 72 as illustrated in FIGS. 7 and 9.

In this process, the edge guide 25 returns to the guide position from the retraction position.

Next, an operation of the recording apparatus 11 will be described.

When the user causes the recording apparatus 11 to perform the printing, the user sets the medium M having a desired size on the cassette 22 or the supply tray 23. A type of medium M having a size with a high use frequency is accommodated in the cassette 22. For example, in a case where the user wants to make printing on a different type of medium M having a different size from the medium M in the cassette 22, the user sets the medium M on the supply tray 23. First, the user pushes the operation lever 67 down to the guide position illustrated in FIG. 3 on the front surface of the recording apparatus 11 and disposes the operation lever at the retraction position illustrated in FIG. 4. At this time, when the operation lever 67 is pushed down to the lower end, the retracting mechanism 70 (heart cam mechanism 71) operates from a position state illustrated in FIG. 9 to a position state illustrated in FIG. 10 in the link with the pushing-down operation, and the edge guide 25 is held (locked) at the retraction position.

The movement of the edge guide 25 from the guide position to the retraction position is detected by a sensor (not illustrated). When the control unit 100 detects that the edge guide 25 is disposed at the retraction position based on a detection signal from the sensor and detects that the hopper 28 is disposed at the feed position, the control unit drives the feed motor 410 such that the hopper 28 is returned to the standby position from the feed position. Therefore, when the user causes the edge guide 25 to move to the retraction position by the operation of the operation lever 67, the hopper 28 is disposed at the standby position at which the hopper is separated from the pickup roller 41. Therefore, it is easy to set the medium M on the mounting surface 23A of the supply tray 23.

In a state in which the edge guide 25 is held at the retraction position, the user sets the medium M on the mounting surface 23A of the supply tray 23. When the setting of the medium M ends, the operation lever 67 is released from the user's hand after the operation lever is pushed again. Then, the locking of the edge guide 25 at the retraction position is canceled, and the edge guide 25 returns to the guide position from the retraction position. Next, the user arranges the positions of the pair of edge guides 25 and 26 in the width direction X and positions the medium M on the supply tray 23 in the width direction X. When the user ends the setting of the medium M, an instruction of performing the printing is instructed from the host device; however, the operation unit 15 of the operation panel 14 is operated to instruct the performing of the printing.

The recording apparatus 11 receives print data from the host device, for example. The print data includes information of designating a feed unit of one of the cassette 22 and the supply tray 23. For example, the supply tray 23 is designated as the feed unit. When the control unit 100 receives an instruction of the printing start by receiving the print data, the control unit drives the feed motor 410 and lifts the hopper 28 via the lifting/lowering mechanism (not illustrated). As a result, the medium M on the supply tray 23 comes into press contact with the pickup roller 41. Then, the control unit 100 drives the feed motor 410 and the transport motor not illustrated and drives the first feed unit 40 and the transport roller pair 53. The media M on the supply tray 23 are fed one by one from the uppermost medium along with the rotation of the pickup roller 41. At this time, one medium M separated by the separating mechanism 42 is fed to the recording unit 54 along the transport passage 52 (particularly, the supply passage 521). An image is recorded (printed) on the medium M based on the print data in the process in which the medium passes through the position opposite to the recording unit 54. The recorded medium M1 after the printing is reversed along the transport passage 52 (particularly, the reverse transport passage 523) and is discharged from the discharge port 29 onto the stacker 24 in the recessed portion 13.

In addition, in a case where the medium M is fed from the cassette 22, the medium M is fed from the cassette 22 through the supply passage 522 to the recording unit 54, and the recorded medium M1 is reversed along the reverse transport passage 523 and is discharged from the discharge port 29 onto the stacker 24 in the recessed portion 13. When the medium M is set, the medium M may be set with the recording surface upward on both of the cassette 22 and the supply tray 23 in normal, and thus it is not easy to erroneously take the recording surface. It is possible to reduce misprinting of printing on a wrong surface during the printing on the medium M such as a postcard or preprinted paper.

In the recording apparatus 11, the cassette 22, the supply tray 23, and the stacker 24 are positioned to overlap each other in the vertical direction Z. Therefore, it is possible to relatively shorten the dimension of the recording apparatus 11 in the feed direction Y, and it is possible to reduce the installation space of the recording apparatus 11. In addition, the cassette 22, the supply tray 23, and the stacker 24 are positioned to overlap each other in the vertical direction Z, and the grip portion 22A of the cassette 22 and the first opening 131 are positioned on the front surface side of the recording apparatus 11. Therefore, the user can perform the setting of the medium M and the taking out of the recorded medium M1 from the front of the recording apparatus 11. Therefore, the user does not need to turn to the side of the recording apparatus 11 so as to set the medium M or to take out the recorded medium M1. Therefore, a work space is not provided on the side of the recording apparatus 11, and this contributes to a reduction in occupied space of the recording apparatus 11.

In addition, since the stacker 24 is disposed on the upper side of the supply tray 23 in a state in which the stacker covers the upper side of the supply tray 23, the dust is unlikely to be accumulated on the medium M even when the medium M remains as is set on the supply tray 23. Therefore, the dust accumulated on the upper surface of the medium is unlikely to infiltrate to the feed unit 40 and the recording unit 54 along with the medium M during the feeding of the medium M. As a result, it is possible to prevent a friction coefficient of the rollers 41, 43, and 44 and the like constituting the first feed unit 40 from decreasing due to the infiltrating dust or clogging of the nozzles of the recording unit 54 due to the dust. Accordingly, a defect such as printing error by an ejection error due to double feed, skewing, transport position displacement and jam of the medium M or clogging of the nozzles is unlikely occur.

According to the embodiment described above, it is possible to obtain the following effects.

(1) The recording apparatus 11 includes a supply tray 23 (an example of the mounting unit) that is provided with the mounting surface 23A on which the medium M is mountable and is open on at least one side of one side in the direction intersecting with the supply direction of the medium M and an upstream side in the supply direction of the medium M, and cassette 22 (an example of the medium accommodating unit) that accommodates the medium M. In addition, the recording apparatus 11 includes the first feed unit 40 (an example of the first supply unit) that supplies the medium M mounted on the supply tray 23 in the supply direction; the second feed unit 45 (an example of the second supply unit) that supplies the medium M accommodated in the cassette 22; the recording unit that performs recording on the supplied medium M; and the stacker 24 (an example of receiving unit) that receives the medium M1 after the recording which is discharged from the discharge port 29. The cassette 22, the supply tray 23, and the stacker 24 are disposed to overlap each other in the vertical direction Z. Accordingly, the recording apparatus 11 is reduced to be small in size in the direction intersecting with the vertical direction Z. Accordingly, it is possible to reduce an occupied space of the recording apparatus 11 to a small size in a configuration of including the supply tray 23 and the stacker 24.

(2) The recording apparatus 11 further includes: a reverse transport passage 523 (an example of the reverse transport route) through which the recorded medium M1 is transported along with reversing of the medium; and the discharge roller pair 57 (an example of the discharge unit) that discharges the reversed medium M1 from the discharge port 29 to the stacker 24. Accordingly, the medium M fed from the supply tray 23 or the cassette 22, on which the recording has been performed by the recording unit 54, is reversed through the reverse transport passage 523 and is discharged from the discharge port 29 to the stacker 24. Therefore, the supply tray 23 and the stacker 24 can be disposed on the same side with respect to the recording unit 54. As a result, it is easy to secure the amount of overlap of the supply tray 23 and the stacker 24. Accordingly, the recording apparatus 11 can have a small size in the direction intersecting with the vertical direction Z, and thereby it is possible to reduce the occupied space of the recording apparatus 11 to a small size.

(3) When the recording apparatus 11 is viewed horizontally from front, the supply tray 23 and the stacker 24 are disposed in the positional relationship in which the projection region PA1 of the stacker 24, which is obtained in a case where the stacker 24 is projected on the supply tray 23 in the vertical direction Z is included in the supply tray 23. Accordingly, since it is possible to secure a large amount of overlap of the supply tray 23 and the stacker 24, it is possible to reduce the recording apparatus 11 to a small size in a lateral direction when viewed horizontally from front. As a result, the occupied space of the recording apparatus 11 can be reduced to a small size.

(4) In the recording apparatus 11, the stacker 24 covers the upper side of the supply tray 23. Accordingly, even when the medium M remains as is mounted on the supply tray 23, the dust is unlikely to be accumulated on the medium M. Therefore, it is possible to reduce double feed, skewing, transport position displacement, and jam of the medium M due to a decrease in friction coefficient of the rollers 41, 43, and 44, in which the dust is caught up, or nozzle clogging of the recording unit 54 due to the dust.

(5) The recording apparatus 11 includes the image reading device 30 (an example of the scanner) having the scanner main body 31. When the recording apparatus 11 is viewed horizontally from front, the supply tray 23 and the scanner main body 31 are disposed in the positional relationship in which the projection region PA2 of the supply tray 23, which is obtained in a case where the supply tray 23 is projected on the scanner main body 31 in the vertical direction Z, is included in the scanner main body 31. In other words, when the recording apparatus 11 is viewed horizontally from front, the scanner main body 31 and the supply tray 23 overlap each other in the vertical direction Z in a state in which the scanner main body 31 includes the projection region PA2 of the supply tray 23. Therefore, it is easy to secure a large amount of overlap of the supply tray 23 and the scanner main body 31. Accordingly, the recording apparatus 11 is reduced to have a small size in the lateral direction when viewed horizontally from front, thereby making it possible to reduce the occupied space of the recording apparatus 11 to a small size.

(6) The housing 12 is provided with the recessed portion 13 above the cassette 22, which is open by the first opening 131 on one side (front surface side in the example) in the width direction X intersecting with the feed direction Y of the medium M on the supply tray 23 and is open by the second opening 132 on the upstream side in the feed direction Y of the medium M on the supply tray 23. In this manner, the supply tray 23 and the stacker 24 overlap each other in the vertical direction Z in the recessed portion 13. Accordingly, the user can perform the mounting of the medium M to the supply tray 23 and the taking out of the recorded medium M1 from the stacker 24 from the front surface side of the recording apparatus 11. Therefore, better usability is obtained when the user accesses the work passage from the front of the recording apparatus 11, and the space necessary to be secured on the side of the housing 12 becomes small. Accordingly, this contributes to the reduction in occupied space of the recording apparatus 11.

(7) The cassette 22 that can accommodate the medium M is provided on the lower side of the supply tray 23, the downstream end of the medium M in the feed direction Y which is accommodated in the cassette 22 is positioned to be closer to the side of the recording unit 54 in the feed direction Y than the downstream end of the medium M in the feed direction Y which is mounted on the supply tray 23 when viewed from the vertical direction Z. In this manner, the first feed unit 40 and the second feed unit 45 are disposed in a state in which at least a part of each of the first feed unit and the second feed unit is positioned at the same height as each other in the vertical direction Z. Accordingly, the size (height size) of the recording apparatus 11 in the vertical direction Z can be reduced to be smaller (lower), compared to a configuration in which the first feed unit 40 and the second feed unit 45 do not have a portion that is disposed at the same height in the vertical direction Z at all. Accordingly, an occupied space of the recording apparatus 11 in the height direction is reduced to be small.

(8) The supply tray 23 tilts in the posture in which the downstream end of the medium M on the mounting surface 23A in the feed direction Y is positioned on the lower side in the vertical direction Z than the upstream end thereof. Accordingly, the leading ends are easily and neatly arranged when the media M are mounted on the supply tray 23, and there is no need to provide the tail end edge guide for guiding tail ends of the media M. The supply tray 23 has the tilting posture, and thereby it is possible to secure the relatively long length of the medium M that can be mounted in proportion to the length of the supply tray 23 in the horizontal direction, compared to a case of a non-tilting posture (for example, a case of a horizontal posture). Accordingly, the size of the recording apparatus 11 in the feed direction Y is reduced to be small. In this manner, the occupied space of the recording apparatus 11 in the feed direction Y can be reduced to a small size. In addition, the supply tray 23 has the tilting posture, and thereby no or small amount of the upstream-side end portion of the supply tray 23 in the feed direction Y extends outside from the upstream-side end portion of the stacker 24, and thus the dust is unlikely to be accumulated on the medium M even when the medium M remains as is mounted on the supply tray 23.

(9) In both of the transport from the supply tray 23 (an example of the mounting unit) to the recording unit 54 and the transport from the cassette 22 to the recording unit 54, the medium M is not reversed. Therefore, the user may be aware that the printing is normally performed on one surface (the upper surface in the example) of both of the front and back surfaces of the medium M and may set the medium M with the surface, on which the printing is performed, upward. Accordingly, it is possible to reduce misprinting of printing on a wrong surface with an incorrect orientation set during the printing on a postcard or preprinted paper.

(10) When viewed from the front surface side of the recording apparatus 11, on which there is a standing position of the user when the user operates the operation panel 14, the supply tray 23 is laid out in the recessed portion 13 so as to have an orientation in which the depth direction is the width direction of the medium M and the lateral direction is the feed direction Y (supply direction) of the medium M. Therefore, it is possible to set the medium M while checking the medium from side, and it is possible to reliably and easily perform the setting work. Here, the reverse transport passage 523 through which the medium M fed from the supply tray 23 is reversed after the printing is employed, and thereby it is possible to discharge the recorded medium M1 onto the stacker 24 that is disposed in the recessed portion 13 similarly to the supply tray 23.

(11) During the setting work of setting the medium M on the supply tray 23, the edge guide 25 that is positioned on the forward side of the front surface of the supply tray 23 interferes with the setting work. However, in the embodiment, the edge guide 25 is configured to be movable between the guide position at which the edge guide is disposed when guiding the medium M in the width direction X and the retraction position at which the edge guide is retracted by being displaced downward from the guide position. Accordingly, when the user sets the medium M on the supply tray 23 via the first opening 131 from front of the recording apparatus 11, the setting work of the medium M is easily performed without much interference by the edge guide 25. Therefore, there is no need to secure the work space for the user who sets the medium M by turning to the side (side of the second opening 132) of the housing 12, and this contributes to a reduction in occupied space of the recording apparatus 11.

(12) The supply tray 23 has the mounting surface 23A on which the medium M is mounted and the hopper 28 that is movable between the feed position at which the medium M on the mounting surface 23A comes into contact with the pickup roller 41 and the standby position at which the medium is separated from the pickup roller 41. When the user performs the operation of moving the edge guide 25 from the guide position to the retraction position in the state in which the hopper 28 is disposed at the feed position, the hopper 28 is configured to move from the feed position to the standby position in the link with the operation by the control performed by the control unit 100. Accordingly, when the user manually moves the edge guide 25 from the guide position to the retraction position, and the hopper 28 is disposed at the feed position at that time, the hopper 28 moves from the feed position to the standby position, and thus a space for performing the setting of the medium M is secured between the pickup roller 41 and the hopper 28. Therefore, it is easy to mount (set) the medium M on the supply tray 23.

(13) The retracting mechanism 70 includes the heart cam mechanism 71 (an example of the holding mechanism) that has the locking function of holding (locking) the edge guide 25 at the retraction position. Accordingly, during the setting work of mounting the medium M on the supply tray 23, the locking function of the heart cam mechanism 71 enables the edge guides 25 and 26 to be held at the retraction position. Therefore, the user does not need to set the medium M with one hand while the user holds the edge guide 25 with one hand toward the retraction side, and thus the user can set the medium M with both hands as necessary. When the user slightly pushes the operation lever 67, the locking of the heart cam mechanism 71 is canceled and the edge guides 25 and 26 return to the guide position from the retraction position. Therefore, it is possible to adjust the position of the edge guides 25 and 26 in the width direction X and to position the medium M on the supply tray 23 in the width direction X. Accordingly, it is easy to perform the setting work of the medium M onto the supply tray 23.

Second Embodiment

Next, a second embodiment will be described with reference to FIGS. 13 to 18. The following second to fourth embodiments are the same except for only a configuration of the retracting mechanism 70 of the edge guide, and the other configurations of the recording apparatus 11 are the same as those in the first embodiment. Hereinafter, the retracting mechanism 70 of the edge guide 25 will be described in detail.

Figure 13:
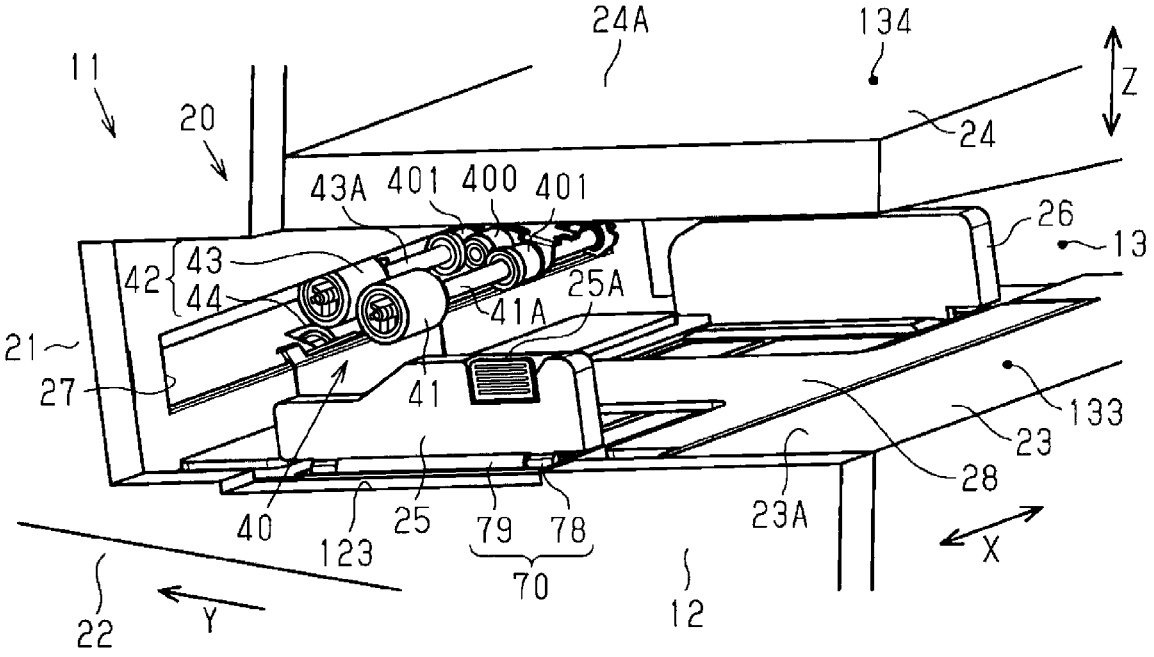
FIG. 13 is a perspective view schematically illustrating a supply tray in a state in which an edge guide is disposed at a guide position in a second embodiment.
Figure 14:
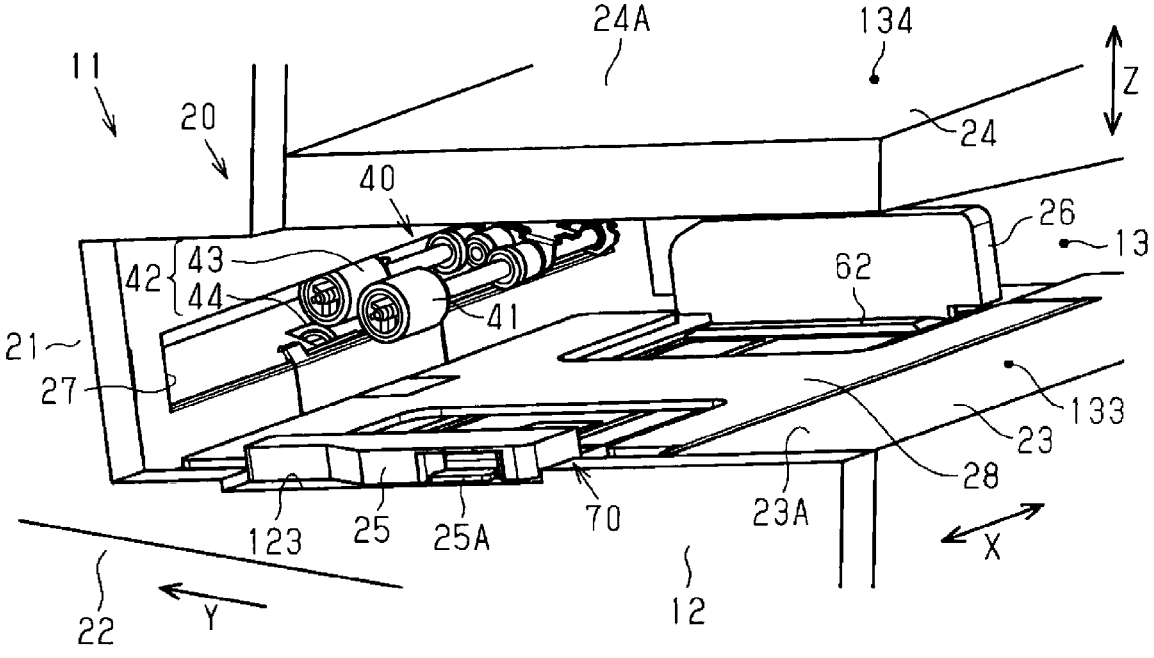
FIG. 14 is a perspective view schematically illustrating the supply tray in a state in which the edge guide is disposed at a retraction position.

As illustrated in FIG. 13, the supply tray 23 includes the retracting mechanism 70 that rotates the edge guide 25 around a side of a lower end portion of the edge guide 25 as a rotation axis. The retracting mechanism 70 includes a shaft portion 78 provided on the lower end portion of the edge guide 25 and a cylindrical guide portion 79 that the shaft portion 78 penetrates. The shaft portion 78 is integrally formed on the lower end portion of the edge guide 25 in a state of extending in the feed direction Y, and the guide portion 79 is provided to project on the upper surface of the base portion 62 (refer to FIG. 15). The edge guide 25 moves, by the retracting mechanism 70, between the guide position illustrated in FIG. 13 at which the edge guide can guide the medium M in the width direction X intersecting with the feed direction Y and the retraction position at which the edge guide rotates around the shaft portion 78 and lies down as illustrated in FIG. 14. The edge guide 25 lies down on the forward side to the retraction position from the guide position, and it is possible to decrease the second area which is the projection area described above when the edge guide 25 is disposed at the retraction position, compared to the first area as the projection area described above when the edge guide 25 is disposed at the guide position, and thus a wide passage is secured to be used when the medium M is set on the supply tray 23 via the first opening 131 from front of the recording apparatus 11. The first area and the second area are the same as defined in the first embodiment.

Figure 15:
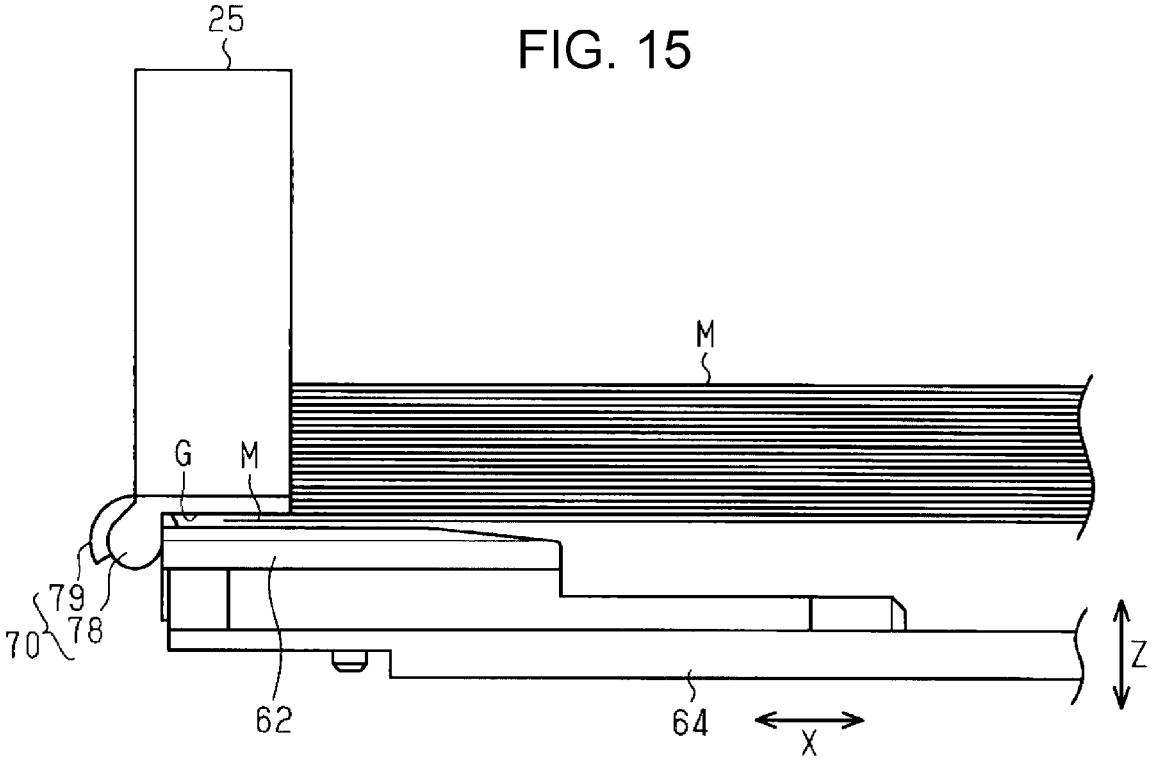
FIG. 15 is a rear view schematically illustrating a supply tray in a state in which an edge guide is disposed at a guide position in a comparative example.

Incidentally, when the retracting mechanism 70 of the edge guide 25 employs a rotating method illustrated in FIGS. 13 and 14, a gap G is formed due to a component tolerance, looseness, or the like of the edge guide 25 and the base portion 62 between the upper surface of the base portion 62 and an under surface of the edge guide 25 when the edge guide 25 is disposed at the guide position as illustrated in FIG. 15. When the media M on the mounting surface 23A are positioned in the width direction X by the pair of edge guides 25 and 26, at least one medium M enters the gap G. In this case, the medium M entering the gap G is fed as is not positioned in the width direction X, and thereby a shift in the printing position, skewing, and jam of the medium M occur at a high frequency of occurrence.

Figure 16:
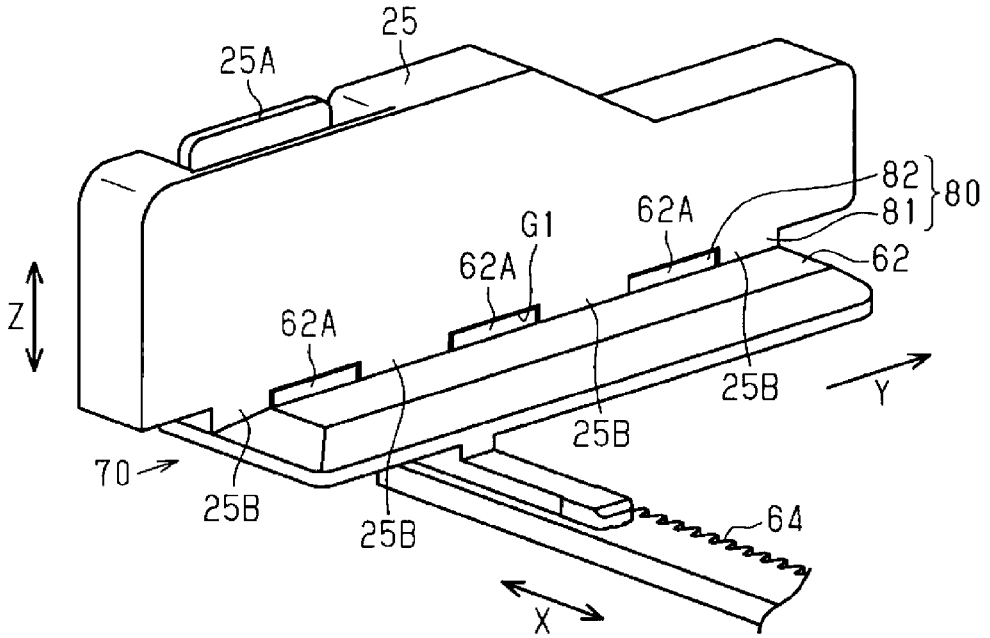
FIG. 16 is a perspective view schematically illustrating a state in which the edge guide is disposed at the guide position.
Figure 17:
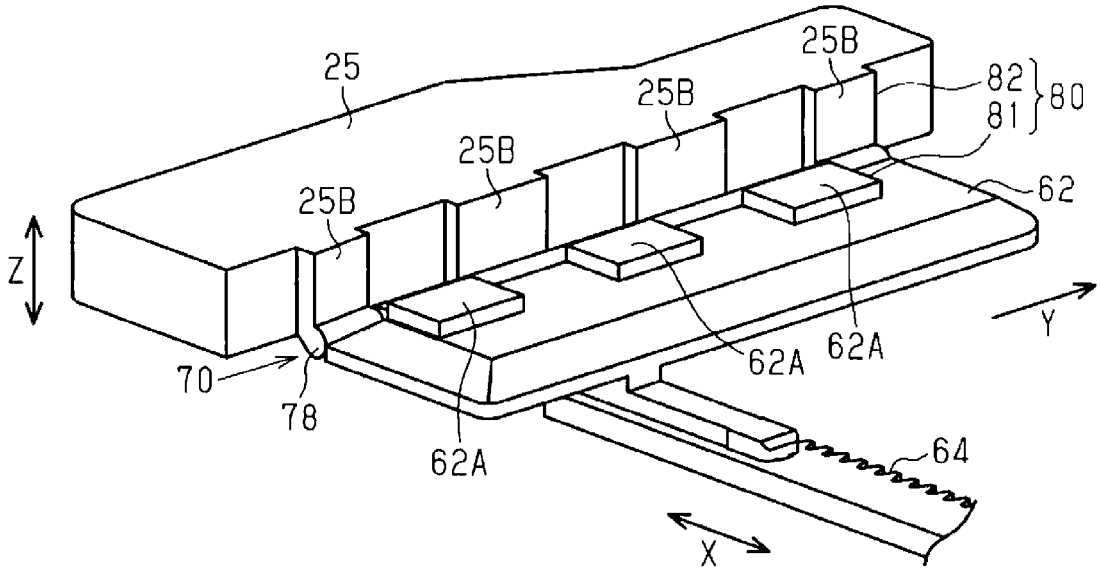
FIG. 17 is a perspective view schematically illustrating a state in which the edge guide is disposed at a retraction position.

When the gap G is very small, the medium M is unlikely to enter the gap; however, in this case, quite high machining accuracy and assembly accuracy are required, and there is a concern that manufacturing costs of the supply tray 23 will increase. In the embodiment, as illustrated in FIGS. 16 and 17, a medium entering preventive mechanism 80 that prevents the medium from entering the gap is provided. The medium entering preventive mechanism 80 is provided with a comb teeth portion 81 having a plurality of projecting portions 62A that project upward in a state where the projecting portions are aligned on the upper surface of the base portion 62 in the feed direction Y and a comb teeth portion 82 having a plurality of projecting portions 25BA that project at positions corresponding to recessed portions between the plurality of projecting portions 62A on the side of the base portion 62 in a state in which the projecting portions are aligned from the under surface of the edge guide 25 in the feed direction Y.

Figure 18:
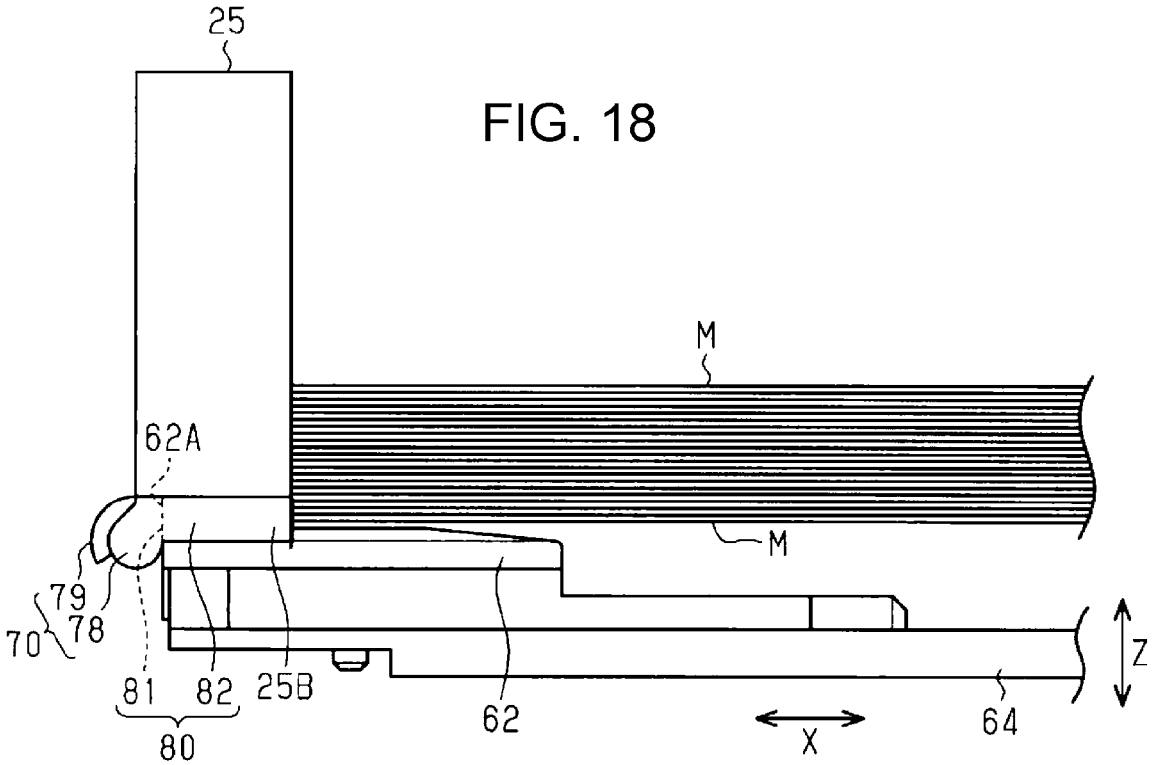
FIG. 18 is a rear view schematically illustrating a supply tray in a state in which an edge guide is disposed at a guide position in an example.

When the edge guide 25 is rotated around the shaft portion 78 to the guide position illustrated in FIG. 16 from the retraction position illustrated in FIG. 17, the comb teeth portions 81 and 82 mesh with each other in a loose-fitting state illustrated in FIG. 16, and thereby the gap G (FIG. 15) extending straight in the feed direction Y is not formed. Therefore, as illustrated in FIG. 16, in a state in which the edge guide 25 is disposed at the guide position, a gap G1 formed between the upper surface of the base portion 62 and the under surface of the edge guide 25 has an uneven shape with both of the comb teeth portions 81 and 82 meshing with each other. Accordingly, one medium M cannot enter the gap G1 having the uneven shape between the base portion 62 and the edge guide 25. Therefore, as illustrated in FIG. 18, all of the media M on the mounting surface 23A of the supply tray 23 are positioned in the width direction X by the pair of edge guides 25 and 26. As a result, when the media M positioned in the width direction X by the pair of edge guides 25 and 26 are fed from the supply tray 23, the frequency of occurrence of a shift in the printing position, skewing, and jam decreases.

According to the second embodiment, it is possible to achieve the following effect, in addition to the same effects as the effects (1) to (12) of the first embodiment.

(14) The edge guide 25 is movable between the guide position and the retraction position with the side of the lower end portion of the edge guide 25 as the rotation axis. Since the retracting mechanism 70 is a rotation type in which the edge guide 25 rotates around a shaft portion 97A of the lower end portion with respect to the base portion 62, the edge guide 25 can be configured to be movable to the guide position and the retraction position in a relatively simple configuration. In a case where the retracting mechanism 70 of the edge guide 25 is the rotation type, there is a concern that the medium M will enter a gap formed between the edge guide 25 and the base portion 62. In the embodiment, the under surface of the edge guide 25 and the upper surface of the base portion 62 are both provided with projecting portions 25B and 62A which can mesh with each other when the edge guide 25 is disposed at the guide position, and thereby the medium entering preventive mechanism 80 is provided. Accordingly, even in a case where the rotation type in which the edge guide 25 is rotatable with respect to the base portion 62 is employed, the medium M positioned in the width direction X by the pair of edge guides 25 and 26 does not enter the gap G1 having the uneven shape which is formed by the meshing between the projecting portions 25B and 62A. Therefore, it is possible to prevent the defect such as the shift in the printing position, skewing, or jam due to the medium entering this type gap.

Third Embodiment

Next, the third embodiment will be described with reference to FIGS. 19 to 23. The retracting mechanism 70 of the edge guide 25 of the third embodiment employs the same rotation type as that of the second embodiment; however, a holding mechanism 90 (locking mechanism) that locks the edge guide 25 at the guide position is provided.

Figure 19:
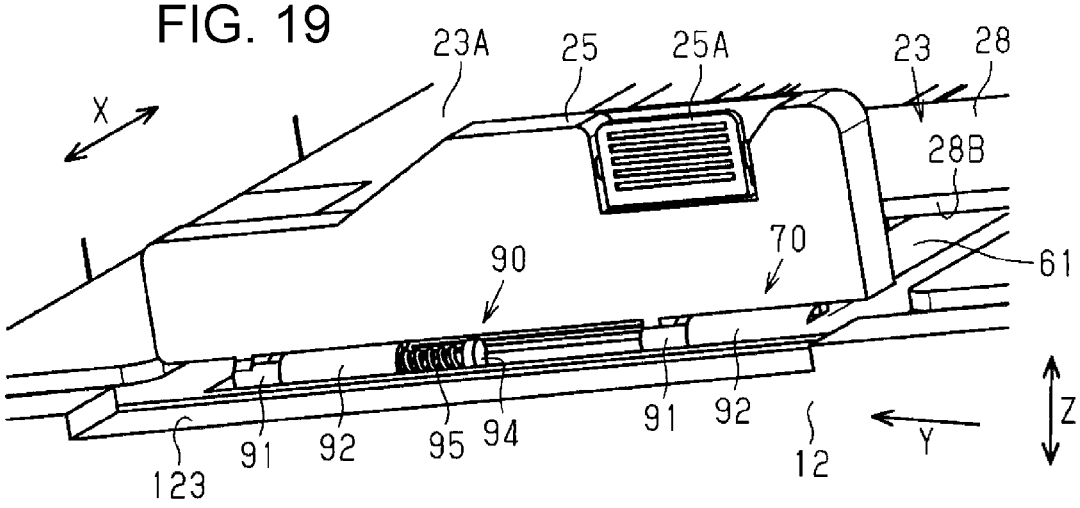
FIG. 19 is a perspective view schematically illustrating a supply tray in a state in which an edge guide is disposed at a guide position in a third embodiment.
Figure 22:
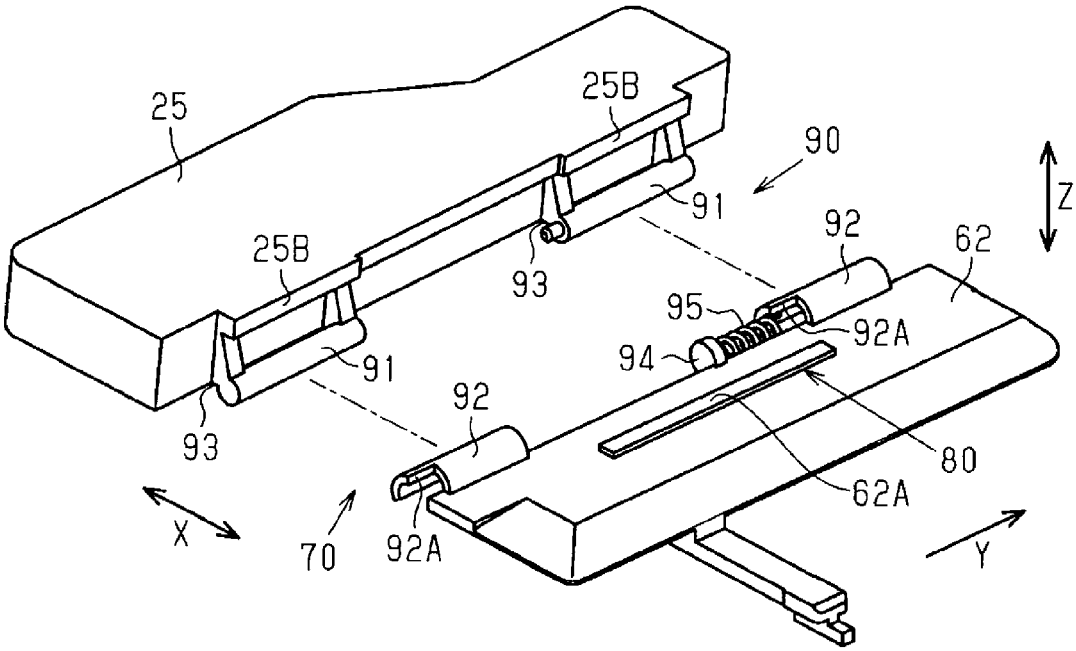
FIG. 22 is an exploded perspective view illustrating the edge guide.

As illustrated in FIG. 19, the lower end portion of the edge guide 25 is provided with a pair of shaft portions 91 extending in the feed direction Y and a pair of cylindrical guide portions 92 projecting to positions corresponding to the pair of shaft portions 91 on the end portion of the upper surface of the base portion 62 (refer to FIG. 22). The holding mechanism 90 is provided between two penetrating positions at which the pair of shaft portions 91 penetrate the pair of guide portions 92, respectively. The holding mechanism 90 includes one plate-shaped spring receiving portion 94 projecting from the end portion of the upper surface of the base portion 62 to a position close to the pair of guide portions 92 and a spring 95 configured of a coil spring installed between the spring receiving portion 94 and an end surface of the shaft portion 91 penetrating the guide portion 92 on a side close to the spring receiving portion. A detailed configuration of the holding mechanism 90 is described below.

As illustrated in FIG. 19, when the edge guide 25 is disposed at the guide position, the shaft portion 91 and the guide portion 92 are disposed in a positional relationship illustrated in FIG. 19 in which the shaft portion 91 relatively moves with respect to the guide portion 92 in a direction on an opposite side to the spring 95 by an elastic force of the spring 95. At this time, the spring 95 is in an extension state in which the spring is slightly compressed from a natural length. In the state illustrated in FIG. 19, the edge guide 25 is locked by the holding mechanism 90 and is held at the guide position at which the edge guide is upright with respect to the base portion 62 (refer to FIG. 22).

Figure 20:
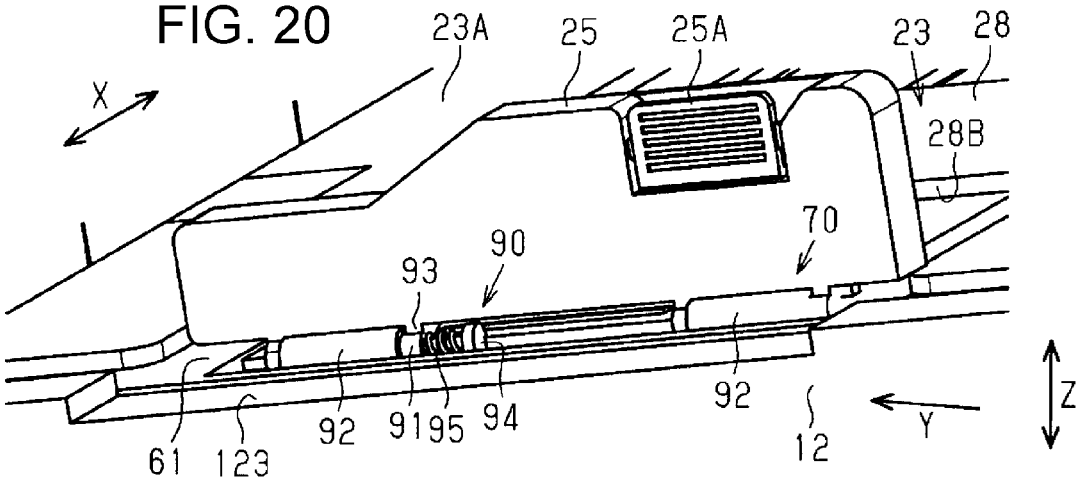
FIG. 20 is a perspective view schematically illustrating a state in which locking of the edge guide to the guide position is canceled.

When the edge guide 25 disposed at the guide position in FIG. 19 is manually moved to the upstream side in the feed direction Y, the shaft portion 91 moves to the upstream side (right side in FIG. 20) with respect to the guide portion 92 while the spring 95 is compressed as illustrated in FIG. 20. In this manner, the locking of the holding mechanism 90 is canceled. Therefore, the user can rotate the edge guide 25 from the guide position illustrated in FIG. 20 to the retraction position illustrated in FIG. 21.

As illustrated in FIG. 22, the edge guide 25 has a regulation surface 93 at a position in the vicinity of one end portion of the shaft portions 91 in an axial direction. On the other hand, the guide portion 92 in the base portion 62 has a regulation surface 92A formed by forming a notch in a part of one end portion of the guide portion in a longitudinal direction. The holding mechanism 90 has the regulation surfaces 92A and 93, in addition to the spring receiving portion 94 and the spring 95 described above.

Figure 23:
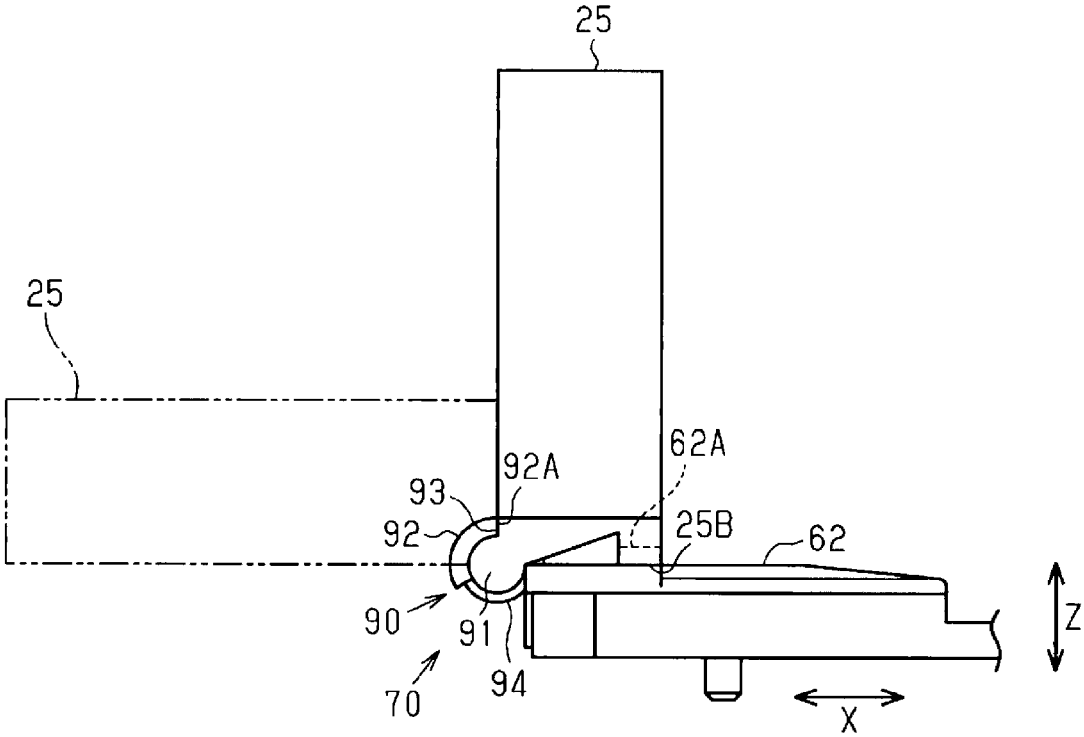
FIG. 23 is a rear view schematically illustrating the edge guide.

As illustrated in FIGS. 19 and 23, when the edge guide 25 is disposed at the guide position, a positional relationship in which the shaft portion 91 abuts both of the regulation surfaces 92A and 93 with respect to the guide portion 92 in the feed direction Y is established, and thereby the edge guide 25 is in the locking state (holding state) in which the rotation is regulated by the abutment of the regulation surfaces 92A and 93. As illustrated in FIG. 20, when the edge guide 25 is caused to slightly slide to the upstream side, the shaft portion 91 relatively moves with respect to the guide portion 92 in a direction in which the spring 95 is compressed, and the edge guide is in an unlocking state (holding canceled state) without abutment on both of the regulation surfaces 92A and 93. Therefore, the user can rotate the edge guide 25 in the unlocking state between the guide position (FIG. 20) and the retraction position (a two-dot chain line in FIGS. 21 and 23). In addition, as illustrated in FIG. 22, the medium entering preventive mechanism 80 that can form the uneven gap by the meshing between the projecting portions 25B and 62A is provided with the projecting portion 62A formed on the upper surface of the base portion 62 and the two projecting portions 25B formed on a circumferential edge of the under surface of the edge guide 25.

Figure 21:
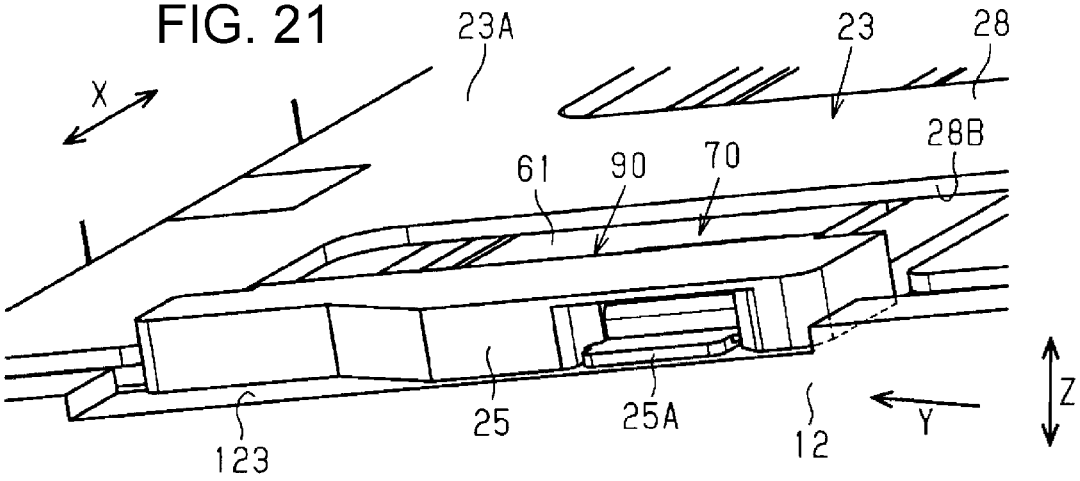
FIG. 21 is a perspective view schematically illustrating a state in which the edge guide rotates to a retraction position.

Accordingly, when the user causes the edge guide 25 to slightly slide to the upstream side in the feed direction Y from the guide position illustrated in FIG. 19, the locking of the holding mechanism 90 is canceled (FIG. 20). When the edge guide 25 is rotated to the forward side around the shaft portion 91 on the lower end portion and lies down in the unlocking state, the edge guide moves to the retraction position (FIG. 21). In a state in which the edge guide 25 is disposed at the retraction position, a wide passage is secured to be used when the medium M is set from front of the recording apparatus 11, and particularly the bias force for returning to the guide position does not act. Therefore, the edge guide 25 is held at the retraction position. Therefore, the user easily performs the mounting work of mounting the medium M on the mounting surface 23A of the supply tray 23.

When the medium M is mounted on the supply tray 23, and then the edge guide 25 is rotated from the retraction position to the guide position, the edge guide 25 returns to the locking position by the bias force of the spring 95 at the time of coming back to guide position, and thus the edge guide 25 is held (locked) at the guide position. When the edge guide 25 is disposed at the guide position, the uneven gap is formed between the under surface of the edge guide 25 and the upper surface of the base portion 62 with the projecting portions 62A and 25B meshing with each other. Accordingly, one medium M cannot enter the gap between the base portion 62 and the edge guide 25. Therefore, all of the media M on the mounting surface 23A of the supply tray 23 are positioned in the width direction X by the pair of edge guides 25 and 26. As a result, when the media M are fed from the supply tray 23, the frequency of occurrence of a shift in the printing position, skewing, and jam decreases.

According to the third embodiment, it is possible to achieve the following effect, in addition to the same effects as the effects (1) to (12) of the first embodiment and the effect (14) of the second embodiment.

(15) In a case where the retracting mechanism 70 that causes the edge guide 25 to be retracted is the rotation type, there is a concern that the edge guide 25 will rotate due to its own weight or a small external force; however, the holding mechanism 90 that is capable of holding the edge guide 25 at the guide position is provided. Accordingly, since the setting work of the media M, which is performed with the edge guide 25 being retracted, is easily performed, and the edge guide 25 disposed at the guide position does rotate even with its own weight or the small external force, it is easy to perform the positioning work of the medium M by the edge guide 25, and thus it is possible to firmly guide the medium M in the width direction X. In addition, the medium entering preventive mechanism 80 is configured of the projecting portions 25B and 62A which are formed on both of the under surface of the edge guide 25 and the upper surface of the base portion 62 and are provided to be able to mesh with each other when the edge guide 25 is disposed at the guide position. Accordingly, it is possible to relatively simply configure the medium entering preventive mechanism 80.

Fourth Embodiment

Next, the fourth embodiment will be described with reference to FIGS. 24 to 27. The retracting mechanism 70 of the edge guide 25 of the fourth embodiment is the rotation type; however, the rotation direction is different from the second and third embodiment. In other words, the retracting mechanism 70 is the rotation type that is capable of rotating the edge guide 25 with the side of one end portion of the edge guide 25 in the feed direction Y as the rotation axis.

Figure 24:
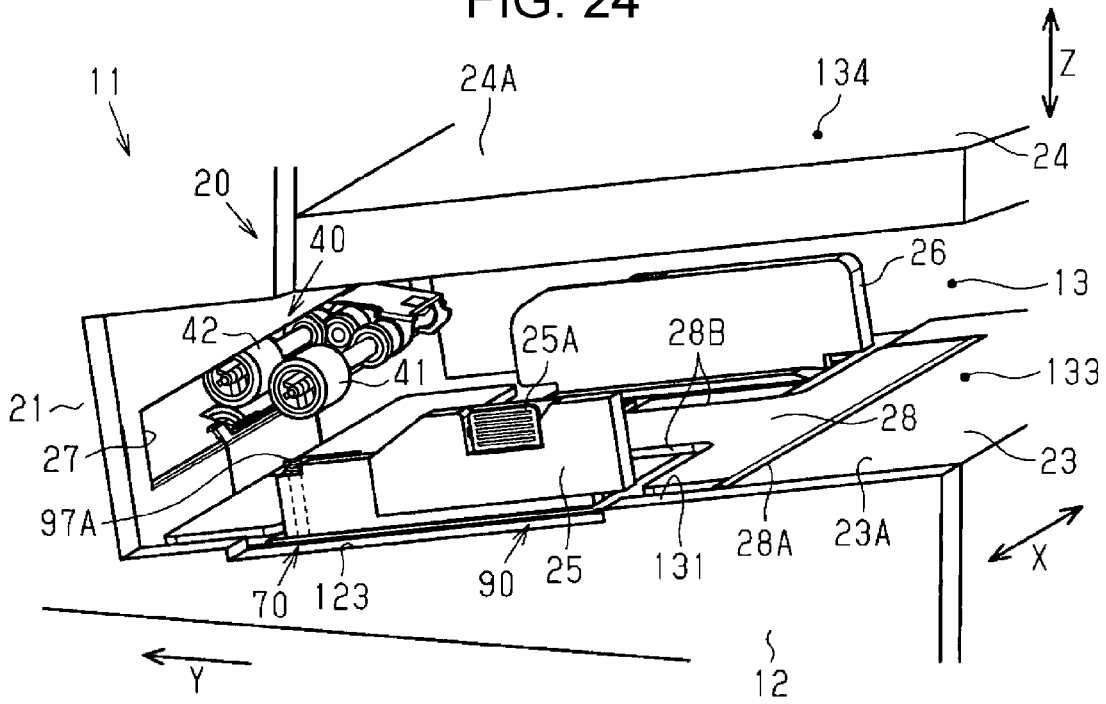
FIG. 24 is a perspective view schematically illustrating a supply tray in a state in which an edge guide is disposed at a guide position in a fourth embodiment.
Figure 26:
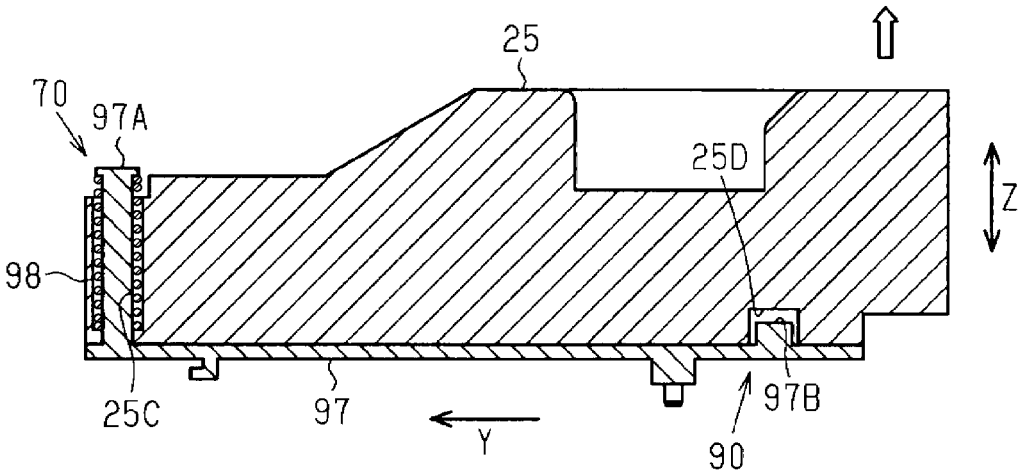
FIG. 26 is a sectional side view schematically illustrating a state in which the edge guide is disposed at the guide position.
Figure 27:
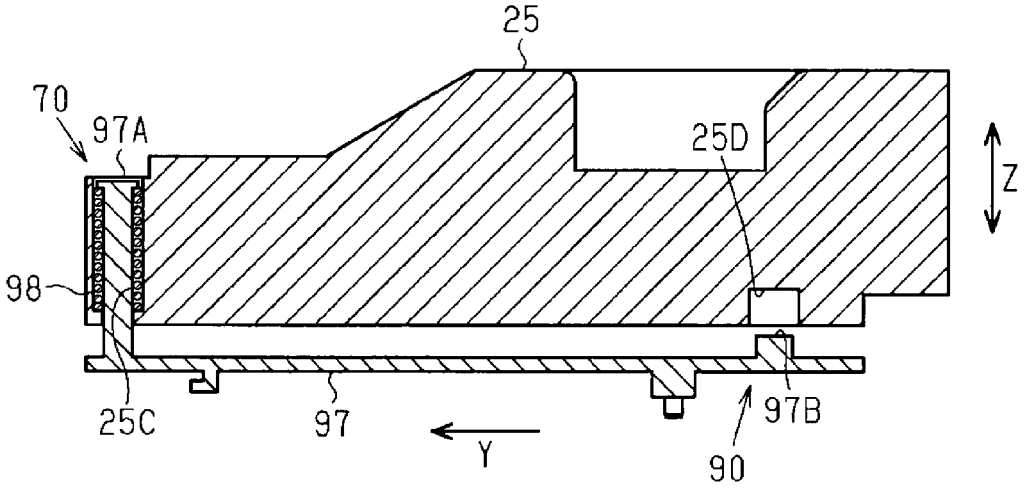
FIG. 27 is a sectional side view schematically illustrating a state in which locking of the edge guide to the guide position is canceled.

As illustrated in FIG. 24, the edge guide 25 is provided to be rotatable around the shaft portion 97A extending in the vertical direction Z which supports the one end portion (downstream-side end portion in the feed direction Y in the example in FIG. 24) in the feed direction Y which is the longitudinal direction. As illustrated in FIGS. 26 and 27, the shaft portion 97A is provided to project almost vertically upward from the upper surface of a support member 97 on one end portion thereof in the longitudinal direction, and the support member is fixed to the upper surface of the base portion 62 (refer to FIGS. 5 and 6). The edge guide 25 rotates around the shaft portion 97A that supports one end of the edge guide in the longitudinal direction, thereby being movable between the guide position illustrated in FIG. 24 and the retraction position illustrated in FIG. 25. In addition, the supply tray 23 is provided with the holding mechanism 90 that locks (holds) the edge guide 25 at the guide position. A portion of the housing 12 which corresponds to the edge guide 25 is provided with a recessed portion 123 for avoiding interference with the housing 12 at the time of rotation of the edge guide 25.

As illustrated in FIGS. 26 and 27, the end portion of the edge guide 25 is provided with a penetrating hole 25C that the shaft portion 97A penetrates, and a spring 98 formed by a coil spring, for example, which biases the edge guide 25 downward in the vertical direction Z with respect to the shaft portion 97A is inserted into the penetrating hole 25C. The spring 98 in inserted thereinto in a state in which the spring is slightly compressed between the upper end portion of the shaft portion 97A and a bottom portion of the penetrating hole 25C in the edge guide 25. The upper surface of the support member 97 is provided with a locking protrusion 97B on an end portion thereof on a side opposite to the shaft portion 97A in the longitudinal direction of the support member. The under surface of the edge guide 25 is provided with a round hole-shaped locking recess 25D at a position corresponding to the locking protrusion 97B of the support member 97. In this manner, the holding mechanism 90 that holds (locks) the edge guide 25 at the guide position is configured of the spring 98, the locking protrusion 97B, and the locking recess 25D.

Figure 25:
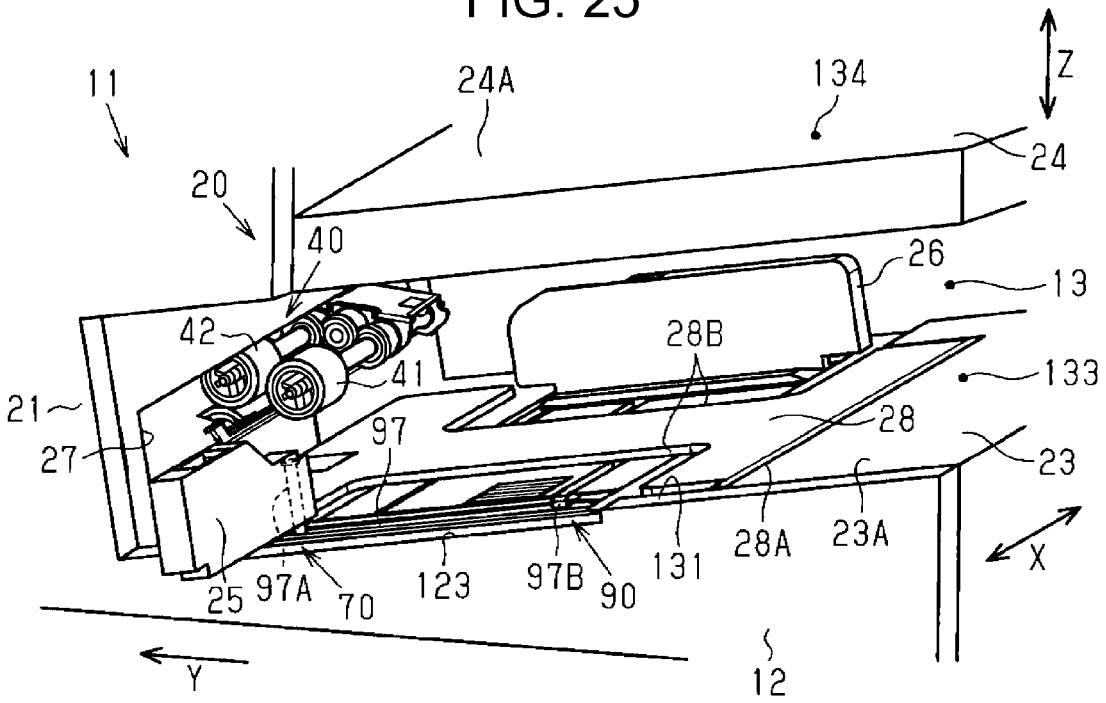
FIG. 25 is a perspective view schematically illustrating the supply tray in a state in which the edge guide is disposed at a retraction position.

As illustrated in FIG. 25, when the edge guide 25 is disposed at the guide position, the edge guide 25 is relatively displaced downward with respect to the shaft portion 97A by the bias force of the spring 98 and is held (locked) at the guide position by the engagement of the locking protrusion 97B and the locking recess 25D. In this manner, when the edge guide 25 is lifted against the bias force of the spring 98 in a direction represented by an outline arrow in FIG. 26, the edge guide 25 is disposed at the unlocking position illustrated in FIG. 27. As illustrated in FIG. 27, in a state in which the edge guide 25 is lifted at the unlocking position, the locking protrusion 97B and the locking recess 25D disengage from each other, and it is possible to move the edge guide 25 between the guide position and the retraction position. Both of the under surface of the edge guide 25 and the upper surface of the support member 97 may be provided with projecting portions which mesh each other when the edge guide 25 is moved to the guide position, and there may be provided a medium entering preventive mechanism that is capable of forming an uneven gap between the edge guide 25 and the support member 97 when the edge guide is disposed at the guide position.

Accordingly, when the user slightly lifts upward the edge guide 25 disposed at the guide position illustrated in FIGS. 24 and 26, the locking of the holding mechanism 90 is canceled (FIG. 27). The edge guide 25 is rotated to the forward side around the shaft portion 97A with the downstream end portion of the edge guide 25 in the feed direction Y as a rotation axis, thereby moving to the retraction position illustrated in FIG. 25. In a state in which the edge guide 25 is disposed at the retraction position, it is possible to decrease the second area which is the projection area described above obtained when the edge guide 25 is disposed at the retraction position in size smaller than the first area which is the projection area described above obtained when the edge guide 25 is disposed at the guide position. Accordingly, if the edge guide 25 is moved from the guide position to the retraction position, the wider work passage is secured to be used when the medium M is set on the supply tray 23 via the first opening 131 from the front of the recording apparatus 11.

When the medium M is mounted on the supply tray 23, then, the edge guide 25 is slightly lifted to be rotated from the retraction position to the guide position, and then the edge guide 25 is released from fingers, the edge guide 25 is lowered by the bias force of the spring 98, and the edge guide 25 is locked at the guide position by the engagement of the locking protrusion 97B and the locking recess 25D. In addition, when the edge guide 25 is disposed at the guide position, the uneven gap is formed by the medium entering preventive mechanism (not illustrated) between the under surface of the edge guide 25 and the upper surface of the support member 97 by the meshing of the projecting portions (not illustrated). Accordingly, since one medium M cannot enter the gap between the edge guide 25 and the support member 97, all of the media M on the mounting surface 23A of the supply tray 23 are positioned in the width direction X by the pair of edge guides 25 and 26. As a result, when the media M are fed from the supply tray 23, the frequency of occurrence of a shift in the printing position, skewing, and jam decreases.

According to the fourth embodiment, it is possible to achieve the following effect, in addition to the same effects as the effects (1) to (12) of the first embodiment.

(16) Since the retracting mechanism 70 of the edge guide 25 is a rotation type in which the edge guide 25 is rotatable around the shaft portion 97A with the one end of the edge guide in the feed direction Y as a rotation axis, the edge guide 25 can be configured to be movable to the guide position and the retraction position in a relatively simple configuration. In addition, in a case where the retracting mechanism 70 is the rotation type, there is a concern that the edge guide 25 will rotate due to its own weight or a small external force; however, the holding mechanism 90 that is capable of holding the edge guide 25 at the guide position is provided. Accordingly, since the setting work of the media M, which is performed with the edge guide 25 being retracted, is easily performed, and the edge guide 25 disposed at the guide position does not rotate even with its own weight or the small external force, it is easy to perform the positioning work of the medium M in the width direction X by the edge guide 25, and thus it is possible to firmly guide the medium M in the width direction X.

The embodiments described above may be modified as follows.

In the second to fourth embodiments, a holding mechanism that holds the edge guide 25 at the retraction position may be provided.

The holding mechanism (first embodiment) that holds the edge guide 25 at the retraction position or the holding mechanism (third or fourth embodiment) that holds the edge guide 25 at the guide position may be configured to perform the holding by the magnetic force of a magnet. The holding mechanism that performs the holding at the retraction position has a magnet on one side of the side surface on the outside of the edge guide 25 and an inner bottom surface (upper surface) of the recessed portion 123 of the housing 12 and a ferromagnetic material (for example, metal having a ferromagnetic property) on the other side. The holding mechanism that performs the holding at the guide position has the magnet and the ferromagnetic material on opposite surfaces of the edge guide 25 and the base portion 62. In addition, the holding mechanism may be configured to hold the edge guide at the retraction position and the guide position by a hook or a snap fit.

The retracting mechanism 70 may be configured not to have a holding mechanism. In a case where the locking mechanism is not provided in the first embodiment, it is possible to perform the setting work of the medium M while holding the edge guide 25 at the retraction position by hand.

In a case where the retracting mechanism 70 of the edge guide 25 is the rotation type, a returning mechanism that causes the edge guide 25 to return to the guide position by a bias force of a spring may be provided.

In the fourth embodiment, the edge guide 25 is rotated around the upstream-side end portion in the feed direction Y as a rotation axis, and thereby the edge guide may be configured to move to the guide position and the retraction position.

In the embodiments described above, the retracting mechanism that moves the edge guide from the guide position to the retraction position may be removed.

The supply tray 23 (mounting unit) and the stacker 24 (receiving unit) may each have at least a part of overlap in the vertical direction Z. In the embodiment described above, when one of the mounting unit and the receiving unit which overlap each other in the vertical direction Z in a front view is projected on the other in the vertical direction Z, an occupying ratio of the projection region of the one that is included in the projection region of the other is 80% to 100%; however, the ratio may be lower than 80%. In addition, when one of the mounting unit and the receiving unit is projected on the other in the vertical direction Z, the occupying ratio of the projection region of the one that is included in the projection region of the other may be 80% or higher in both of the feed direction Y and the width direction X. Further, the projection area obtained by projecting one of the mounting unit and the receiving unit on the other in the vertical direction Z satisfies 80% or higher and lower than 100% in the ratio of the one to the other; however, the ratio may be lower than 80% or 100%.

At least one of the mounting unit (supply tray 23) and the receiving unit (stacker 24) may have a part that projects outside from at least one of the openings 131 and 132. For example, even when at least one of the mounting unit and the receiving unit has a part that projects outside from the opening 131 on the front surface side, it is necessary to basically secure a space in which the user stands on the front surface side, and thus the projecting part is not considered as an increase in occupied space of the recording apparatus 11. In addition, for example, even when at least one of the mounting unit and the receiving unit has a part that projects outside from the opening 132 on the side surface side, it is possible to relatively reduce the occupied space of the recording apparatus 11, compared to a configuration in which at least one of the mounting unit and the receiving unit projects outside almost entirely.

The supply tray 23 as an example of the mounting unit may be open on both sides or only on one side in a direction (for example, the width direction X) intersecting with the feed direction Y of the medium M on the mounting surface 23A. In this case, the supply tray 23 may be open only on one side in the width direction X or may be open on both sides in the width direction X. It is preferable that the front surface side of the recording apparatus 11 be open. In addition, the supply tray 23 may be open only on the upstream side in the feed direction Y of the medium M. Further, the supply tray 23 may be open on both of the upstream sides in a direction (for example, the width direction X) intersecting with the feed direction Y of the medium M and in the feed direction Y. In this case, only one side in the width direction X may be open or both sides may be open.

It is possible to appropriately change the number of surfaces and the position of the surface which are open by the opening, of the external side surfaces (side circumferential surfaces) of the housing 12. In the embodiments described above, a portion of the rear surface of the recessed portion 13 may be open by an opening or three side surfaces of the housing 12 may be open by openings. In addition, in a case where two side surfaces of the housing 12 are open by openings, two surfaces of the front surface and the rear surface of the housing 12 may be open by openings or two surfaces of the side surface and the rear surface of the housing 12 may be open. In addition, a configuration, in which the printing function unit 21 is disposed on the right side of the housing 12 when viewed from front and the front surface and the left side surface of the housing 12 are open by openings, may be employed. Further, only one side surface of the housing 12 may be open by an opening. For example, only the front surface of the housing 12 may be open by the opening 131, only the left side surface and the right side surface of the housing 12 may be open by the opening 132, or only the rear surface of the housing 12 may be open by an opening. It is desirable that a plurality of openings are continuous to each other and are open when the surfaces having openings of the housing 12 are adjacent to each other. In addition, it is preferable that at least front surface of the housing 12 be open by the opening, and it is possible to access the mounting unit and the receiving unit in the recessed portion via the opening on the front surface of the recording apparatus.

The positional relationship between the supply tray 23 and the stacker 24 in the vertical direction Z may be reversed. In other words, the supply tray 23 may be positioned above the stacker 24. Even in this configuration, it is possible to reduce the occupied space of the recording apparatus 11 to a small size. In addition, even when the medium M remains as is mounted on the supply tray 23, the upper side of the supply tray is covered with the image reading device 30, and thus the dust is unlikely to be accumulated on the medium M on the supply tray 23.

It is possible to change the order of the cassette 22 as an example of the medium accommodating unit, the supply tray 23 as an example of the mounting unit, and the stacker 24 as an example of the receiving unit in the vertical direction Z into any order. For example, the cassette 22 may be disposed on top, and the supply tray 23 and the stacker 24 may be disposed below the cassette 22. In addition, the cassette 22 may be disposed between the supply tray 23 and the stacker 24 in the vertical direction Z.

The mounting unit may be a manual feed unit (manual feed tray) that is provided with the hopper 28 that can feed the mounted media M one by one. Even when a manual feed unit on which the media M are set one by one is provided, it is possible to reduce the occupied space of the recording apparatus 11 to a small size.

The supply direction of the medium M1 from the mounting unit (for example, the supply tray 23) and the discharge direction of the recorded medium M1 to the receiving unit (for example, the stacker 24) are not limited to the lateral direction when viewed from front of the recording apparatus 11, and the direction may be the depth direction. In this case, it is desirable that the medium accommodating unit (for example, the cassette 22) is disposed in an orientation in which the grip portion 22A is disposed on the forward side on the front surface, and thus the supply direction of the medium M from the medium accommodating unit is also the depth direction. In addition, the feed direction of the medium accommodating unit, the supply direction of the mounting unit, and the discharge direction of the receiving unit may be an oblique direction intersecting with both of the lateral direction and the depth direction in a front view of the recording apparatus 11. Even in this configuration, it is possible to perform the mounting of the medium M on the mounting unit and the taking out of the recording medium from the receiving unit via the opening 131 in the front surface of the recording apparatus 11. In this manner, since the medium accommodating unit (for example, the cassette 22), the mounting unit, and the receiving unit overlap each other in the vertical direction Z, it is possible to reduce an occupied space of the recording apparatus 11 to a small size.

The recording apparatus 11 is not limited to an ink jet printer and, for example, may be a dot impact printer, a thermal transfer printer, and an electrophotographic printer (for example, a laser printer).

The recording apparatus 11 is not limited to a serial recording type or a line recording type and may be a lateral scanning type in which a recording head constituting a recording unit is movable with a carriage in two directions of a main scanning direction and a sub-scanning direction.

The recording apparatus 11 is not limited to the multifunction printer having a plurality of functions including the printing function and may be a printer that does not include the image reading device but includes only the printing function. In this case, the recording apparatus 11 may have a configuration in which the housing 12 has a member or an extending portion that covers the upper side of one disposed above, of the supply tray 23 and the stacker 24 which overlap each other in the vertical direction Z.

The recording apparatus 11 may be a multifunction printer or a printer that does not include the medium accommodating unit such as the cassette.

The recording apparatus 11 is not limited to the recording apparatus that records an image or the like on a medium such as a sheet of paper or a film and may be an industrial printing apparatus that is used to manufacture a sheet-like object such as component parts, a semi-finished product, or a product by using a printing technology (ink jet technology). Examples of the type of industrial printing apparatus include a liquid discharge apparatus that discharges a liquid body containing a material such as an electrode material or color material (pixel material) on a sheet-shaped substrate which is used in manufacturing or the like of a display such as a liquid crystal display, an electroluminescence (EL) display, or a field emission display. Further, the recording apparatus may be a 3-D ink jet printer that discharge a liquid such as a resin liquid and manufactures a three-dimensional object having a sheet shape.

The entire disclosure of Japanese Patent Application No. 2017-147020 filed on Jul. 28, 2017 and No. 2018-035272 filed on Feb. 28, 2018 are expressly incorporated by reference herein.

What is claimed is:

1. A recording apparatus comprising:

a mounting unit that is provided with a mounting surface, on which a medium is mountable, and that is open on at least one side of one side in a direction intersecting with a supply direction of the medium on the mounting surface and an upstream side in the supply direction of the medium;

a medium accommodating unit that accommodates a medium;

a first supply unit that supplies the medium mounted on the mounting unit in the supply direction;

a second supply unit that supplies the medium accommodated in the medium accommodating unit;

a recording unit that performs recording on the supplied medium;

a receiving unit that receives the medium after the recording, a reverse transport route through which a medium, on which recording has been performed, is transported along with reversing of the medium;

a discharge unit that discharges the reversed medium from a discharge port to the receiving unit; and a scanner that reads a document and is disposed higher than the discharge unit in a vertical direction in the supply direction, wherein the medium accommodating unit, the mounting unit, and the receiving unit are disposed to overlap each other in a vertical direction, wherein, in a medium discharge direction, an upstream end and a downstream end of the receiving unit are disposed within a range of an upstream end position and a downstream end position of the mounting unit, wherein the downstream end of the receiving unit in the medium discharge direction and the upstream end of the mounting unit in the supply direction are disposed within a recess of a housing recording apparatus so that the downstream end of the receiving unit in the medium discharge direction and the upstream end of the mounting unit in the supply direction do not extend beyond the recess, wherein, the receiving unit is disposed below the scanner, and is disposed between the first supply unit and the discharge unit in a vertical direction, wherein the mounting unit has an edge guide that is able to guide the medium in a width direction intersecting with the supply direction, wherein the edge guide is configured to be movable between a guide position at which the edge guide guides the medium in the width direction and a retraction position at which the edge guide retracts downward from the guide position while keeping the guide posture, and wherein the edge guide is rotatable to the guide position guiding the medium in the width direction and the retraction position to retract to the opposite side of the mounting surface.

2. The recording apparatus according to claim 1, wherein the receiving unit covers an upper side of the mounting unit.

3. The recording apparatus according to claim 2, wherein, when viewed horizontally from front, the mounting unit and the scanner are disposed in a positional relationship in which the scanner includes a projection region of the mounting unit, which is obtained in a case where the mounting unit is projected on the scanner in the vertical direction.

4. The recording apparatus according to claim 3, wherein the mounting unit tilts in a posture in which a downstream end of the mounted medium in the supply direction is positioned on a lower side than an upstream end thereof in the vertical direction.

5. The recording apparatus according to claim 4, wherein a downstream end of the medium accommodated in the medium accommodating unit in the supply direction is positioned to be closer to the recording unit in the supply direction than the downstream end of the medium mounted on the mounting unit in the supply direction, and wherein the first supply unit and the second supply unit are disposed in a state in which at least a part of each of the first supply unit and the second supply unit is positioned at the same height in the vertical direction.

6. The recording apparatus according to claim 1, further comprising:

a holding mechanism that holds the edge guide at the retraction position.

7. The recording apparatus according to claim 1, wherein the edge guide is rotatable to the guide position and the retraction position around a side of a lower end portion or a side of one end portion of the edge guide in the supply direction as a rotation axis, and wherein an upper surface portion of the mounting unit and an under surface portion of the edge guide are uneven to mesh with each other in a state in which the edge guide is disposed at the guide position.

8. The recording apparatus according to claim 1, wherein the mounting unit has a hopper that is movable between a feed position at which the medium mounted on the mounting unit comes into contact with a roller constituting the first supply unit and a standby position at which the medium is separated from the roller, and wherein, when the edge guide moves from the guide position to the retraction position in a state in which the hopper is disposed at the feed position, the hopper is caused to move from the feed position to the standby position.

9. A recording apparatus comprising:

a mounting unit that is provided with a mounting surface, on which a medium is mountable, and that is open on at least one side of one side in a direction intersecting with a supply direction of the medium on the mounting surface and an upstream side in the supply direction of the medium;

a medium accommodating unit that accommodates a medium;

a first supply unit that supplies the medium mounted on the mounting unit in the supply direction;

a second supply unit that supplies the medium accommodated in the medium accommodating unit;

a recording unit that performs recording on the supplied medium;

a receiving unit that receives the medium after the recording;

a reverse transport route through which a medium, on which recording has been performed, is transported along with reversing of the medium;

a discharge unit that discharges the reversed medium from a discharge port to the receiving unit;

a scanner that reads a document and is disposed higher than the discharge unit in a vertical direction in the supply direction; and a recessed portion that accommodate the mounting unit and the receiving unit, wherein a downstream end of the receiving unit in a medium discharge direction and an upstream end of the mounting unit in the supply direction are disposed within the recessed portion so that the downstream end of the receiving unit in the medium discharge direction and the upstream end of the mounting unit in the supply direction do not extend beyond the recessed portion, wherein the medium accommodating unit, the mounting unit, and the receiving unit are disposed to overlap each other in a vertical direction, wherein the recessed portion is partitioned into a first space and a second space in the vertical direction by the receiving unit disposed above the mounting unit, wherein, the receiving unit is disposed below the scanner, and is disposed between the first supply unit and the discharge unit in a vertical direction, wherein the mounting unit has an edge guide that is able to guide the medium in a width direction intersecting with the supply direction, wherein the edge guide is configured to be movable between a guide position at which the edge guide guides the medium in the width direction and a retraction position at which the edge guide retracts downward from the guide position while keeping the guide posture, and wherein the edge guide is rotatable to the guide position guiding the medium in the width direction and the retraction position to retract to the opposite side of the mounting surface.

10. The recording apparatus according to claim 1, further comprising:

a holding mechanism that holds the edge guide at the retraction position.

* * * * *